US005687906A

United States Patent [19]

Nakagawa

[11] Patent Number: 5,687,906

[45] Date of Patent: Nov. 18, 1997

[54] ATOMIZATION METHOD AND ATOMIZER

[76] Inventor: Mitsuyoshi Nakagawa, 1-21 Kasuga, 1-Chome, Suita City, Osaka, Japan

[21] Appl. No.: 692,495

[22] Filed: Aug. 7, 1996

Related U.S. Application Data

[62] Division of Ser. No. 351,828, Dec. 8, 1994, Pat. No. 5,584,433, which is a continuation of Ser. No. 688,594, filed as PCT/JP89/01291, Dec. 22, 1988, abandoned.

[30] Foreign Application Priority Data

| | | | |
|---|---|---|---|
| Dec. 23, 1988 | [JP] | Japan | 63-326730 |
| Apr. 10, 1989 | [JP] | Japan | 1-091656 |
| Jun. 27, 1989 | [JP] | Japan | 1-164326 |

[51] Int. Cl.[6] ..... B05B 5/04; B05B 1/28

[52] U.S. Cl. ..... 259/8; 239/81; 239/83; 239/296

[58] Field of Search ..... 239/78, 79, 81, 239/83, 84, 290, 293, 296, 299.9, 681, 281, 1, 8, 13; 427/422.2; 219/121.44, 121.5, 121.51, 121.47

[56] References Cited

U.S. PATENT DOCUMENTS

| | | | |
|---|---|---|---|
| 4,095,081 | 6/1978 | Ashmau | 219/76.16 |
| 4,668,852 | 5/1987 | Fox et al. | 239/81 X |
| 4,681,258 | 7/1987 | Jenkins et al. | 239/66 |
| 5,584,433 | 12/1996 | Nakagawa | 239/8 |

*Primary Examiner*—Kevin Weldon
*Attorney, Agent, or Firm*—Morrison Law Firm

[57] ABSTRACT

An atomizing method for atomizing a fluid atomizing material feeds fluid atomizing material into jet air. A pair of planar air jets flow through nozzle tips towards a center axis of an atomization material supply. This forms an air chamber which converges in front of the atomization material supply. The interior edge of the converged air jets has a zone of slow moving air that draws the fluid atomizing material into the converging air jets. The material is thus atomized and evenly distributed. The atomization material supplied includes such fluidized atomizing materials as molten metal droplets fused by arc heat, paints, blast materials, adhesives, powders, etc.

8 Claims, 20 Drawing Sheets

FIG. 10
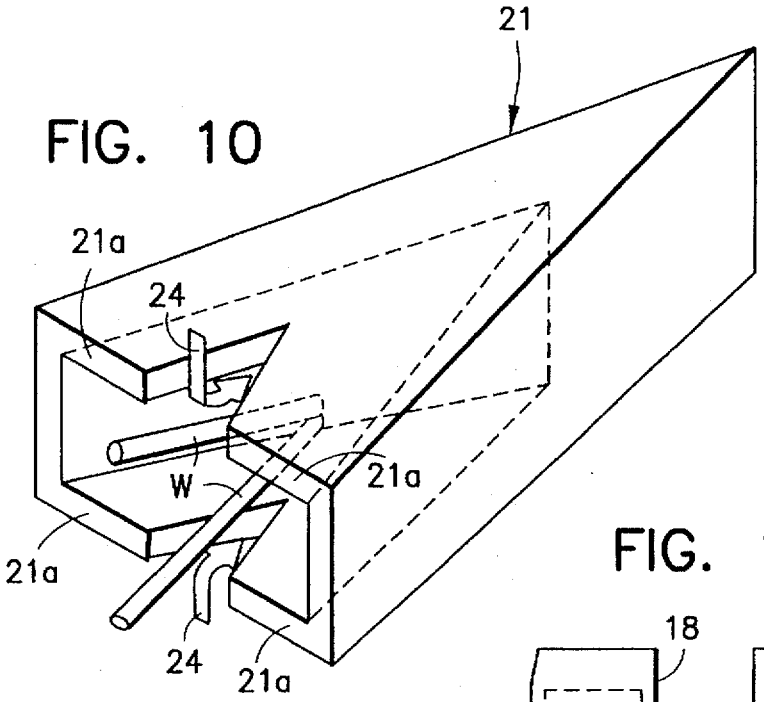
FIG. 11
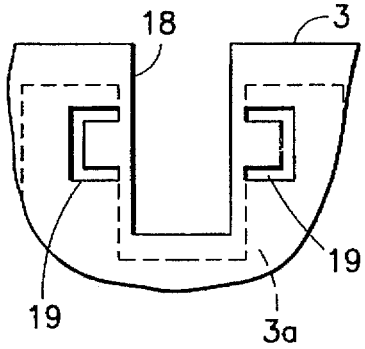
FIG. 12
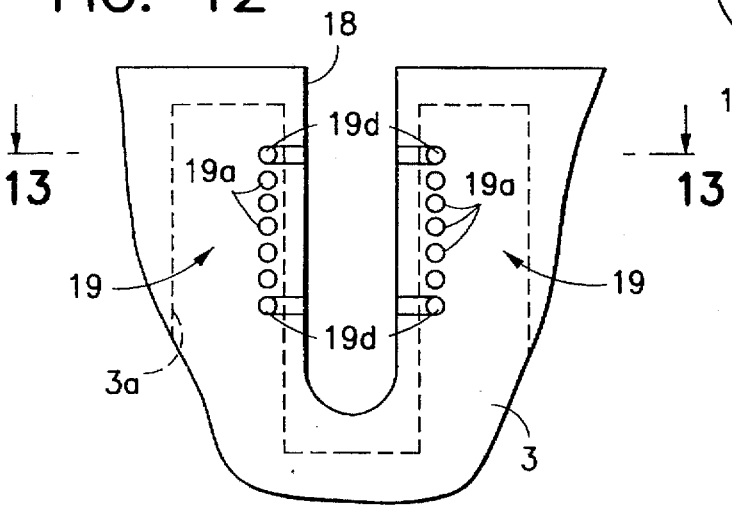
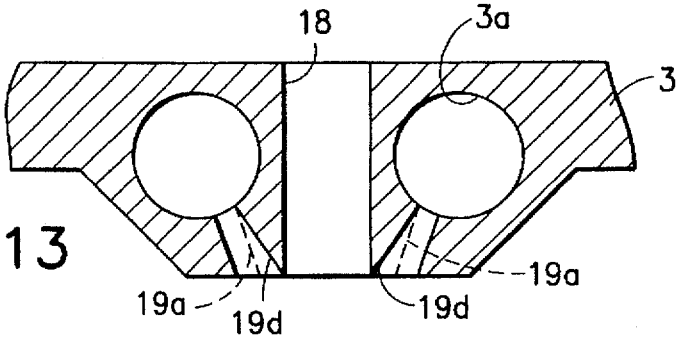
FIG. 13

ATOMIZATION METHOD AND ATOMIZER

This is a divisional of application Ser. No. 08/351,828, filed Dec. 8, 1994 now U.S. Pat. No. 5,584,433 which in turn is a continuation of application Ser. No. 07/688,594, filed on Aug. 22, 1991, now abandoned, which was a national stage filing of PCT/JP89/01291, filed Dec. 22, 1989, which was a continuation in part of Japanese application no. 1-164326, Japanese application no. 1-91656, and Japanese application no. 63-326730.

This invention relates to an improved atomizing method for atomizing a fluid material such as metal molten droplets or paint fused by arc heat from a separately supplied air jet, and jetting its atomized material into a preferred surface, and its atomizing device.

BACKGROUND OF THE INVENTION

According to a conventional technique, a fluid material is atomized by jetting compressed air from a nozzle, dispersing the fluid material in the air, and then jetting it onto a preferred surface. The form for supplying the jetted air flow in this kind of atomizing device varies and depends on respective fluid material.

For example, in a general arc fusing device, a linear or band-shaped metal material is fused by arc heat, atomized by a compressed air for atomizing and jetted, while being cooled, to a given object, thereby an atomized coating is formed on the object. According to this kind of arc fusing device, there are two known systems to supply the compressed air: an external enclosing system to form a main air jet curtain at an external side of an arc area and a penetrating system to jet the main air jet curtain toward the arc area from its central, rear part.

In the external enclosing system, the main air jet curtain is jetted in a conical form from an annular nozzle, thereby forming a low pressure zone inside the conical air flow, and a metal material is supplied in the low pressure zone. Then, arc discharge is carried out, and the metal molten material is atomized on contact with the conical air flow. A fusing device according to this technique is known in Japanese Laid-open Patent Publication No. 61-167472. Further, according to Japanese Laid-open Patent Publication No. 56-10103, in order to supply the metal molten droplets exactly into the main air jet curtain, a second nozzle is disposed behind a center of the arc area, and a supplementary air jet is jetted toward the center of the arc area from the second nozzle.

In this type of fusing device, the main air jet curtain of the conical form is formed outside the metal material and the arc area. For this reason, the foregoing fusing device becomes larger than that of the penetrating system, and its construction also becomes more complicated. In particular, when using band-shaped metal material, the caliber of the annular nozzle must be larger. Otherwise, the arc area cannot be covered by the main air jet curtain.

Further, in the fusing device having the supplementary nozzle disposed behind the center of the arc area, its internal construction becomes more complicated. In this case, two separate air hoses, each having a different air pressure, supply the main nozzle and the supplementary nozzle, respectively.

The penetrating system is provided with the main nozzle for jetting the main air jet behind the center of the arc area, whereby the metal molten droplets are atomized by the main air jet jetted linearly from the main nozzle. This kind of device is disclosed for example in Japanese Laid-open Patent Publication No. 61-181560.

Further, according to Japanese Laid-open Patent Publication No. 60-18463, a pair of supplementary nozzles are disposed outside the arc area independently of the main nozzle, thereby supplementary air is jetted toward a pointed end of the metal material from the pair of supplementary nozzles. Thus, the metal molten droplets are atomized by joint cooperation of the supplementary air and the main air jet.

In the penetrating system, atomization is carried out by jetting the main air jet directly to the arc area. For this reason, the arc area of the metal material is cooled by the main air jet, thereby easily causing abnormally high temperature due to a pinch effect. As a result, oxygen in the main air jet becomes a high temperature and high density ozone, thereby the metal molten is forced to be oxidized severely or to be fused explosively. Thus, the metal molten droplets not yet atomized are jetted to the object, so that coating becomes irregular. To remove this disadvantage, the penetrating system also uses the supplementary nozzles, but the structure is apt to be complicated.

As discussed above, both systems have some merits and demerits in view of construction and fusion performance. Now, it is necessary to make further improvements.

It is therefore a general object of this invention to provide an atomization method and its atomizing device, wherein the construction of the fusing device is simplified, namely more compact and lighter by improving the supply form of the compressed air for atomizing, and improving the stability of the arc heat fusing component.

It is another object of this invention to provide an atomization method and its atomizing device which enables supplying compressed air for atomizing suitable for a band-shaped metal material.

Referring to a second problem of the foregoing fusing device or other type of it, the disadvantage is that its fusing pattern is small and the distribution of minute molten droplets jetted on the object become irregular.

According to a conventional device as shown in FIG. 26, a fusing pattern P2 forms a nearly circular form, so that only a small fusing area is available. By increasing the air quantity to be jetted from a nozzle, it is possible to enlarge the fusing area to some extent. But the arc area of the material is cooled excessively and is susceptible to a pinch phenomenon, thereby it becomes difficult to carry out the arc fusing stably. Further, since either the arc fusing system or a gas fusing system forms a strongly reversing air flow upon the surface of the object to be coated by atomization, the metal molten droplets are spattered without adhering to the object, so that its loss is increased rapidly.

Preferably, a distance between the fusing device and the object is about 20 cm, but it is possible to enlarge the fusing area to some extent by increasing this distance. Yet, in this case, the adhesive force of the atomizer, molten droplets to the surface of the object is decreased, and the anti-stripping strength of the coating is also decreased.

According to the conventional device as shown in FIG. 26, a thickness t of a membrane of the circular fusing pattern P2 is considerably thicker at the central part of it, and becomes thin at its peripheral edge. For this reason, the thickness of the membrane is irregular in a superficial direction, so that a uniform coating cannot be obtained. Further, since the molten droplets are concentratedly jetted to a central part of the object, heat is accumulated in that part, so that the coating is stripped from the object due to a heat expansion difference between the central part and the peripheral part.

As discussed above, an operational efficiency of the present device depends on the size of the fusing pattern area. It takes of course a long time to form a coating having a certain thickness on a given area. Prior to fusing, the object is treated with a blast treatment, thereby its surface is activated, but susceptible to oxidation. Accordingly, the fusing operation must be finished within 2 to 4 hours after the blast treatment. When the area of the object to be coated is too large it becomes impossible to complete the coating step within the 2–4 hour time limit. In that case, it is required to carry out an additional operation including an activating treatment by use of a solvent.

It is another object of this invention to provide a high efficiency fusing device which enables enlargement of the fusing area by several fold and makes the distribution of the membrane a uniform thickness by improving the supply form of the compressed air for atomizing.

An air atomizing spray gun for painting as a typical atomizer is used widely. By disposing an air cap on a nozzle end, paint and air are mixed with each other at the nozzle opening, thereby atomizing the paint. Further, as necessity arises, any additional nozzle may be disposed to promote atomization, adjust a coating pattern or prevent spattering of the paint.

Apart from the foregoing air atomizing system, the spray gun has a popular airless system for causing a friction with an ambient air by jetting at high speed a highly pressurized painting liquid from a small nozzle tip. In either system, such a conventional atomizer for painting needs a nozzle for atomizing the paint liquid. For this reason, clogging at the nozzle is always a problem. Every time spraying is carried out, a cumbersome cleaning work is required. Further, most failures such as malfunction of the atomizing device or a bad coating pattern derive from the nozzle. Therefore, it is very cumbersome to keep good maintenance of the nozzle.

Further, such a conventional atomizer has the problem that brings a large quantity of ineffective mists when spraying. Because the paint is atomized at the nozzle tip by a mutually intersecting collision of a plurality of air jets, such unnecessary mists arise. If their quantity is large, the paint liquid is consumed wastefully. In addition, the working environment is polluted by such paint liquid or solvents.

In either Japanese Laid-open Patent Publication No. 59-206066 or Japanese Laid-open Utility Model Publication No. 57-55560 relating to the airless type spray gun for removing ineffective mists, there is disclosed the technique that an annular air nozzle is disposed around a nozzle for jetting paint, and then the atomizing area of the paint is enclosed by the air curtain jetted from the air nozzle. However, when spraying the paint liquid, part of the air curtain simultaneously covers a wet sprayed surface, thereby it is disturbed by the air curtain, and the quality of coating is deteriorated. Further, the disadvantage is that the air nozzle for the air curtain must separately be disposed in addition to the atomizing means.

Further, since the conventional device needs to form atomizing means such as the nozzle accurately and make an accurate position relationship between the atomizing means and the air nozzle, the disadvantage is that the cost for manufacturing the atomizer increases. According to the airless type spray gun, since the paint liquid is pressurized to high pressure of 100 to 200 $Kg/cm^2$, the supply system for the paint is very expensive.

It is another object of this invention to provide an atomization method and its atomizing device, which enables solving the clogging problem of the nozzle and carry out an easy operation.

It is another object of this invention to provide an atomization method and its atomizing device, which enables preventing occurrence of the ineffective mists, eliminate a wasteful consumption of the paint and substantially reduce contamination of the working environment.

After all, the ultimate object of this invention is to atomize the fluid materials such as the metal molten droplets, paint or the like exactly and stably by a novel atomizing means, that enables realizing a high fidelity of the atomizing device and reduces the manufacturing cost.

SUMMARY OF THE INVENTION

The atomizing device according to this invention enables supplying an jetting air flow in the same supply form as the foregoing external enclosing type arc fusing device, but is characterized in that the air chamber formed by the air curtain as a pair of plane air jets is of a V-shape.

More specifically, the atomizing method comprises:

jetting a pair of plane jets of air toward a center axis of means for supplying an atomizing material as a fluid material in a non-atomizing form;

forming an air chamber to be converged by said pair of air jets at a forward end; and supplying said atomizing material into said air chamber in said non-atomizing form to feed said atomizing material into said pair of air jets, thereby enabling atomization.

The atomizing material as a fluid material is for example, metal molten droplets fused by an arc heat, a paint, a blast material, an adhesive, a power or the like. The present inventors have developed a first invention, a second invention and a third invention one after another.

According to the first invention, a fusing center axis is disposed so as to be interposed between a pair of nozzle tips for jetting a pair of plane air jets, and respective jetting center lines of the pair of nozzle tips are inclined toward the fusing center axis, whereby a pair of arc intersecting points are positioned in an air chamber defined by the air jets.

Under such structure, since the minimum area necessary to carry out the arc fusing stably is covered by an air curtain formed by the pair of air jets, the nozzle, as well as the atomizing device, can be constructed compactly.

The arc discharge is carried out continuously in a weaker air flow zone in the air chamber, and molten droplets produced by the arc discharge are fed into the pair of air jets by the weaker air flow in order to atomize molten droplets. In this case, the arc fusing can be conducted stably with no pinch phenomenon.

Further, when fusing a band-shaped fusible material, the air curtain can be formed along its external surface, so that the arc fusing can be conducted by a small-sized nozzle.

Referring to the second invention, a fusing pattern is improved, in which the air chamber has a V-shape and the pair of air jets are intersected to oppose obliquely each other.

More particularly, a position (arc intersecting point) where molten droplets of a fusible material occur is interposed between a pair of nozzle tips for forming a pair of plane air jets. Respective center lines in a width direction of the pair of air jets are inclined toward the fusing center axis in a forward end of the foregoing position (arc intersecting point) and respective center lines in a width direction of the pair of air jets are inclined to oppose each other, thereby both air jets are partially converged and intersected with each other.

Under such structure, the molten droplets are fractionated and dispersed in the air flow consisting of a collected air flow before the convergent portion and the intersected air flow. As a result, as shown in FIG. 26, an elongated circular or elliptical fusing pattern is formed on a given surface. Moreover, the pattern area can be enlarged two to five times larger than the conventional pattern.

According to the third invention, in which a fluid material such as a paint or the like is applied to the atomizing device, it comprises means for supplying an atomizing material in a non-atomizing form and an air nozzle for jetting a pair of air jets to atomize the material. The air nozzle has a pair of nozzle tips for jetting a pair of plane air jets, and the pair of air jets are formed to be converged toward an atomizing center axis. And, means for supplying the atomizing material is disposed in the air chamber surrounded by the pair of air jets.

Like the second invention, preferably, respective center lines in a thickness direction of the pair of air jets are converged toward the atomizing center axis and respective center lines in a width direction are inclined to oppose each other.

In this atomizing device, the atomizing material is discharged through a tube by its own flow or a certain pressure without making use of the nozzle. The atomizing material is supplied into the air chamber by the weaker air flowing toward the convergent portion of the pair of air jets, and absorbed in the air flow. Since there is a big difference between the moving velocity of the atomizing material and that of the air jets, the atomizing material is fractionated finely while passing through the convergent portion, and dispersed in the air flow.

The pair of air jets form a convergent air flow in the convergent portion. It has a strong and regular orientation. While accompanying the ambient air, its velocity is decreased, and then collides with a given surface. Thus, the atomizing material is supplied in a non-atomizing form without the nozzle. Therefore, all problems proper to the nozzle can be eliminated. Further, the atomizing material fractionated in the convergent portion is carried to the given surface by the convergent air flow highly oriented so that occurrence of ineffective mists can be prevented and environmental pollution can also be eliminated.

Accordingly, it is unnecessary to dispose a high accuracy nozzle. Namely, means for supplying the atomizing material as well as a simple air nozzle are sufficient. The atomizing material can be supplied in a non-atomizing form by the foregoing means having a considerably larger diameter, so that the problem of clogging or wear can be eliminated. As discussed above, the atomizing material is fractionated accurately and stably by the pair of air jets.

BRIEF DESCRIPTION OF THE DRAWINGS

FIGS. 1 to 23 show a first invention of the present invention.

FIGS. 1 to 5 show an embodiment of an arc fusing device according to the first invention, in which FIG. 1 is a transverse sectional plan view of a nozzle, FIG. 2 is a longitudinal section view of the nozzle, FIG. 3 is a longitudinal sectional side view of the arc fusing device, FIG. 4 is a transverse sectional plan view of the arc fusing device and FIG. 5 is a front view of the nozzle.

FIGS. 6 and 7 show a further embodiment of the arc fusing device according to the first invention, in which FIG. 6 is a transverse sectional plan view of the arc fusing device and FIG. 7 is a section view taken along A—A line in FIG. 6.

FIGS. 8 to 23 show modifications of the nozzle in the first invention, in which FIG. 8 is a front view of the nozzle, FIG. 9 is a section view taken along line B—B in FIG. 8 and FIG. 10 is a schematic perspective view of a air jet form jetted from the nozzle in FIG. 8.

FIGS. 11 and 12 are respective front views of a modified nozzle tip, and FIG. 13 is a section view taken along line C—C in FIG. 12.

FIG. 14 is a front view of a modified nozzle tip and FIG. 15 is a section view taken along line D—D.

FIGS. 16 and 17 are respective front views of a modified nozzle tip, and FIG. 18 is a transverse section view of a modified nozzle tip.

FIGS. 19 and 20 are respective transverse section views of the nozzle affixed to an additional nozzle tip.

FIGS. 21 and 21*a* are front views of a changed opening position of the additional nozzle tip.

FIG. 22 is a front view of a modified nozzle, and FIG. 23 is a section view taken along line E—E in FIG. 22.

FIGS. 24 to 37 show an embodiment of an arc fusing device according to a second invention, in which FIG. 24 is a side view of a air jet jetting principle, FIG. 25 is a plan view of it, FIG. 26 is a front view of a fusing pattern, FIG. 27 is a longitudinal sectional side view of a fusing device, FIG. 28 is a section view of taken along line F—F in FIG. 27, FIG. 29 is a front view of the fusing device, and FIGS. 30 and 31 are respective section views taken along line G—G and line H—H in FIG. 29.

FIGS. 32 to 37 are respective modifications of a nozzle in the second invention, in which FIG. 32 is a front view of a modified nozzle tip. FIG. 33 is a front view of another modified nozzle tip. FIG. 34 is a front view of another modified nozzle tip. FIG. 35 is a side view thereof. FIG. 36 is a front view of another modified nozzle tip. FIG. 37 is a side view thereof.

FIGS. 38 to 41 show an embodiment of the fusing device according to a third invention, in which FIG. 38 is a view of the principle of the atomizing device, FIG. 39 is a section view taken along line J—J and FIG. 41 is a side view of the atomizing device having changed supply pipe.

FIGS. 42 to 45 show a further embodiment of the fusing device according to the third invention, in which FIG. 42 is a view of the principle of the fusing device, FIG. 43 is a front view of an air nozzle, and FIGS. 44 and 45 are respective section views taken along line K—K and line L—L in FIG. 43.

FIGS. 46 to 48 show another embodiment for applying the third invention to a spray gun for painting, in which FIG. 46 is a transverse sectional side view, FIG. 47 is a front view of an air nozzle and FIG. 48 is a section view taken along line M—M in FIG. 47.

DETAILED DESCRIPTION OF THE PREFERRED EMBODIMENTS

Figure 1:
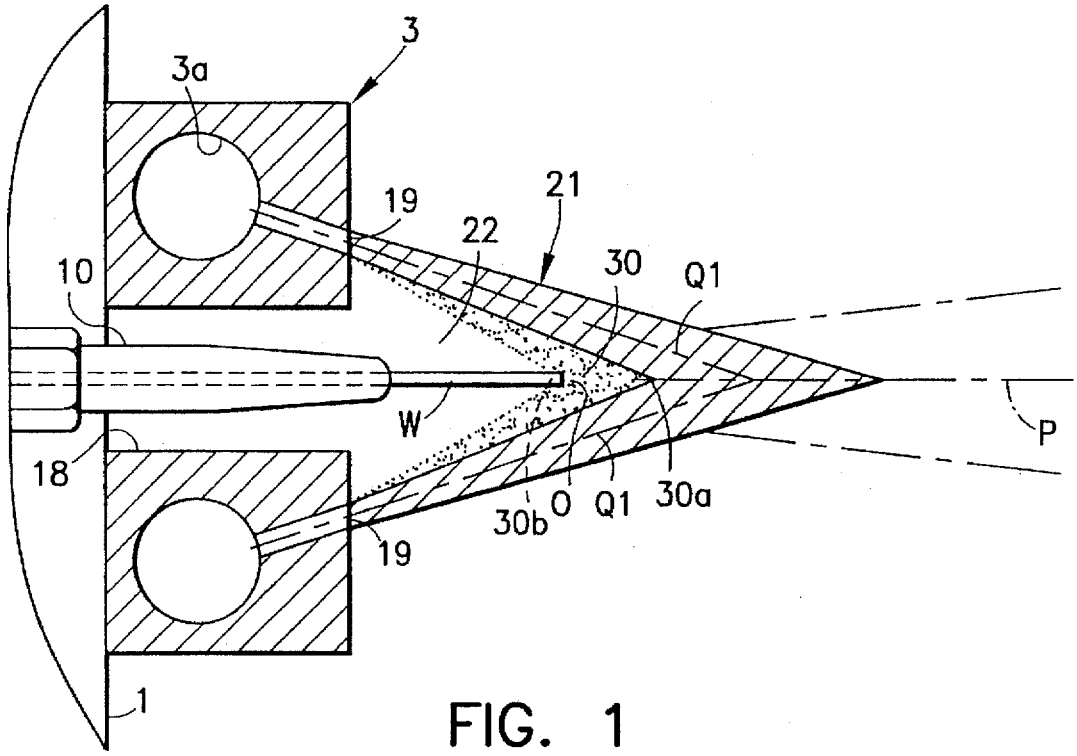
Figure 2:
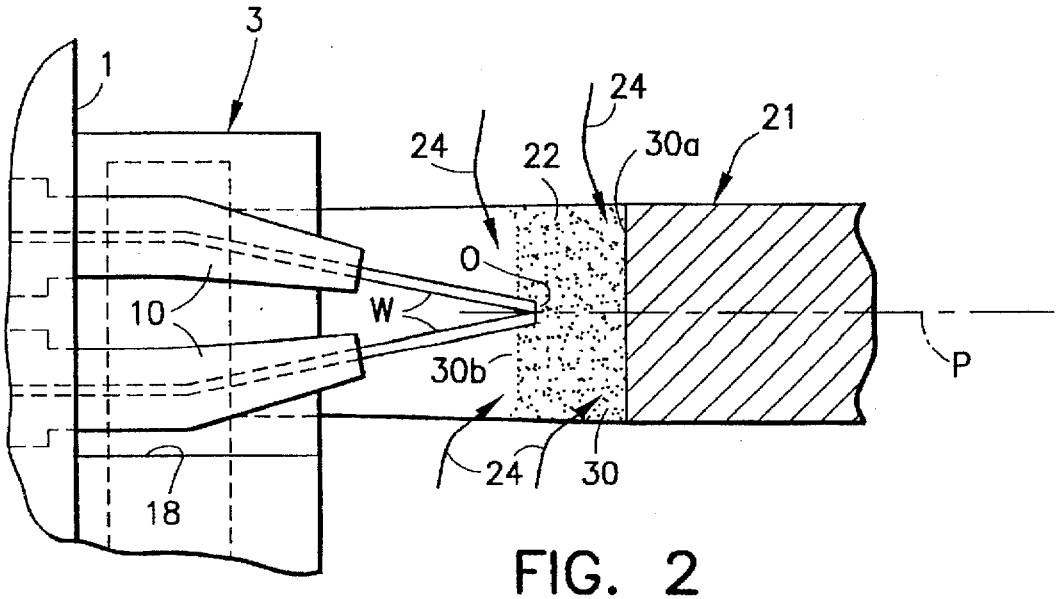
Figure 3:
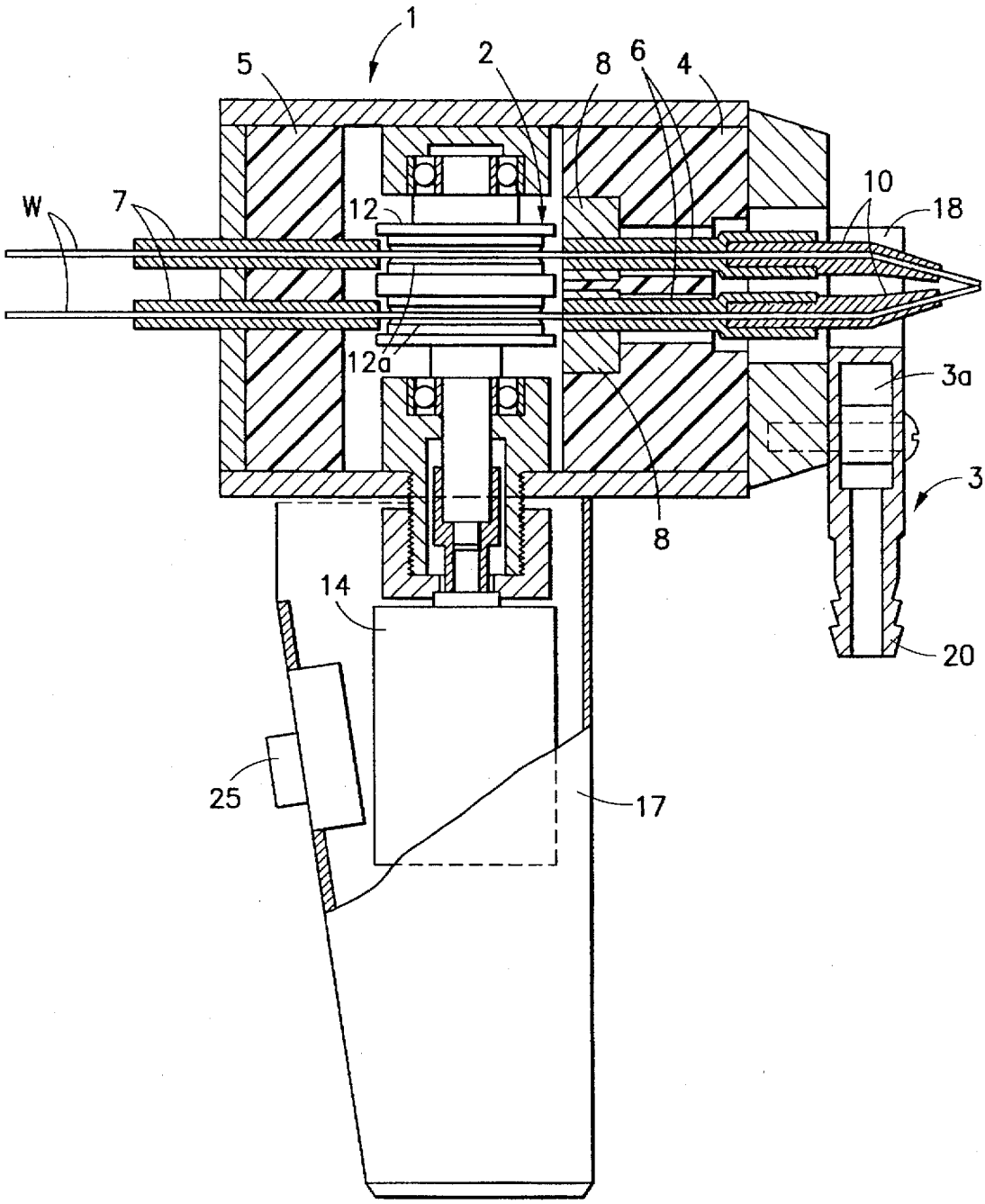

FIGS. 1 to 5 show an arc fusing device according to an embodiment of the first invention. In FIG. 3 the arc fusing device carries out arc fusion by using a linear fusible material W. Disposed in a box-shaped case 1 is a passage for passing the fusible material W therethrough in an upper/lower parallel posture.

Figure 4:
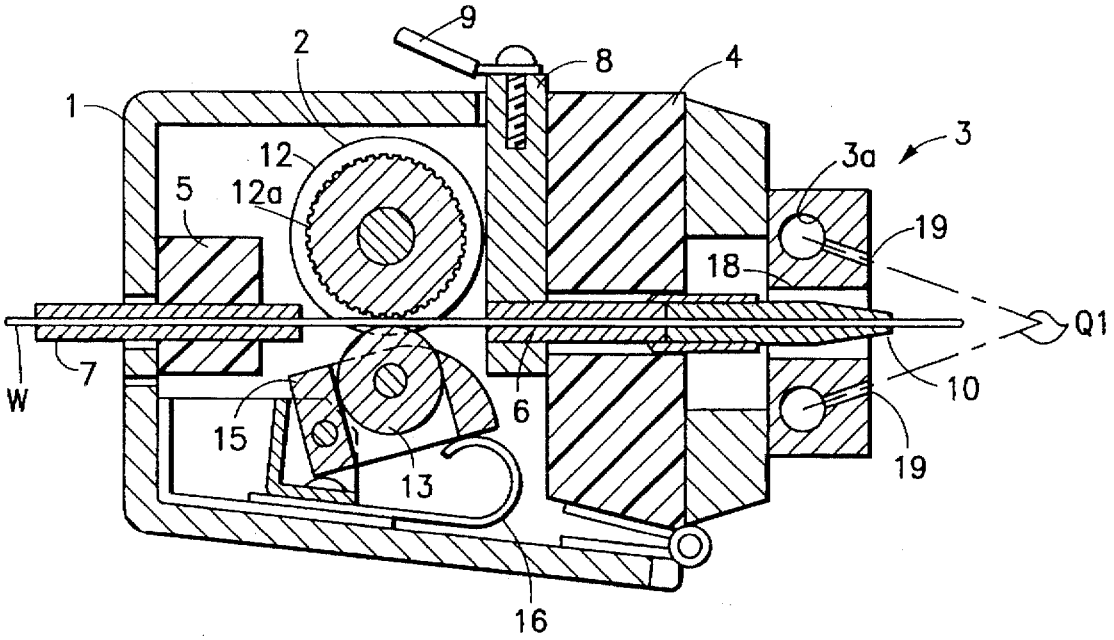

Disposed in a central part of case 1 is means 2 for feeding fusible material W, and protruded outwardly from a front end of case 1 is a nozzle 3 for jetting a plane air jet for atomizing. Case 1 is fixed by a front insulating block 4 and a rear insulating block 5. The passage for passing fusible material W through both insulating blocks 4, 5 is defined by a pair of front/rear guide tubes 6, 7 disposed in parallel. Rear guide tube 7 is directly fixed with insulating block 5, while front guide tube 6 is fixed twistedly with a pair of upper/lower electrode bars 8 disposed in insulating block 4. As shown in FIG. 4, one end of electrode bar 8 is protruded outwardly from the outside of case 1, and a power line 9 is connected to this end. A positive current is applied to one electrode bar 8, while a negative current is applied to the other electrode bar, thereby an arc current is applied to fusible material W through guide tube 6 and an arc guide tube which will be described hereinafter.

So that fusible material W can move toward an arc intersecting point O to be positioned in a forward direction of nozzle 3, a tapered arc guide tube 10 is connected to the front guide tube 6. Due to arc guide tube 10, upper/lower fusible materials W are guided so as to be converged to a fusing center axis P, thereby enabling an accurate application of arc current.

Means 2 for feeding both upper and lower fusible materials W simultaneously comprises, as shown in FIG. 4, a larger driving roller 12, a pair of upper/lower support rollers for supporting fusible materials W on larger driving roller 12 and a motor 14 for driving roller 12. Driving roller 12 is formed by an insulator. A metal ring 12*a* of V-shaped section is inserted in driving roller 12 at its external contact with fusible material W. A periphery of ring 12*a* is formed by notches. Support rollers 13 are rotatably supported on a pair of upper/lower swinging arms 15 and presses respective swinging arms 15 in a direction of driving roller 12 by means of a plate spring 16, thereby fusible material W is pressed on the periphery of ring 12*a* by the force of support rollers 13. Motor 14 is disposed in a grip 17 fixed with the undersurface of case 1, and starts by switching on a switch 25 disposed on a rear surface of grip 17.

Figure 5:
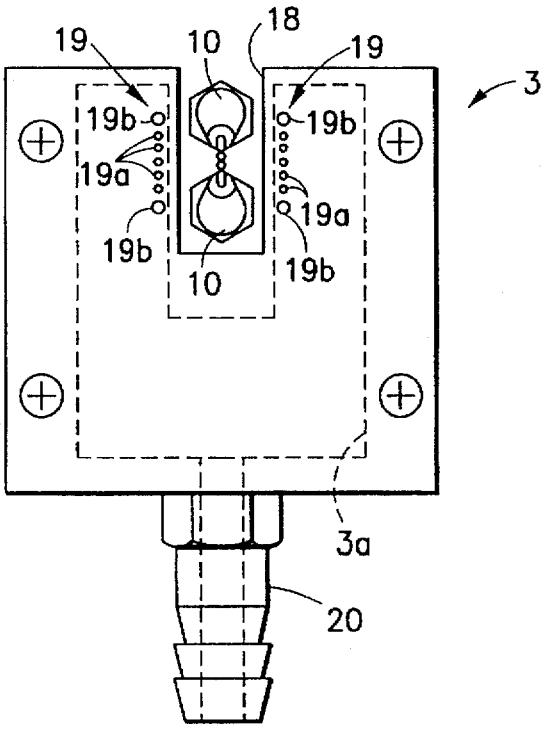

As shown in FIGS. 4 and 5, nozzle 3 is formed in a thin shaped box in a forward and rearward direction. Formed at a center part of the upper half part of nozzle 3 is a recess 18 for inserting arc guide tube 10. A pair of nozzle tips 19 are open along both opposing edges of recess 18 in a symmetrical form relative to the fusing center axis P. Projected from the underside of nozzle 3 is a joint 20 connected to an air hose. A compressed air is supplied into an air chamber 3*a* of nozzle 3 through joint 20.

As shown in FIG. 5, each nozzle tip 19 comprises a group of small holes 19*a* and two upper and lower end holes 19*b* a bit larger than the former. They are positioned linearly in a vertical direction. Further, each of holes 19*a*, 19*b* is inclined so that a jetting center line Q1 in a thickness direction of each hole can be converged to the fusing center line P as shown in FIG. 1.

A V-shaped, plane air jet 21 is converged at its end due to the air jet jetted from leftside and rightside nozzle tips 19, and a wedge-shaped air chamber 22 is formed inside air jet 21. The air velocity within air chamber 22 is weaker than air jet 21, namely forms a weaker air flow zone 30.

The diameter of the air flow jetted from both upper and lower holes 19*b* is larger than that of small holes 19*a*, and has a stronger orientation. Therefore, the sectioned width of air jet 21 at the upper/lower edges of air chamber 22 is wider than at the central part, thereby covering inwardly upper/lower edges thereof. That is, both ends of each air jet 21 form a hook-shaped air flow wall or I-shaped section.

In order that the arc discharge may be carried out within weaker air flow zone 30, a position relationship between nozzle 3 and the arc intersecting point O of fusible material W is determined. More specifically, the arc intersecting point O is positioned, as shown in FIGS. 1 and 2, upon the fusing center axis P between a rear end 30*b* of and a front end 30*a* of air flow zone 30 so that the arc area of fusing material W cannot contact directly air jet 21.

When the arc discharge is carried out under such air supply form, the arc area of the fusible material W is not exposed directly by air jet 21, thereby the arc discharge can be carried out so as to be covered by the air curtain plane forming air jet 21 throughout the whole external surface of arc area. Namely, the external surface of the arc area can completely be covered only by the air flow jetted from pair of nozzle tips 19. Accordingly, whereas the conventional device required a conical nozzle absolutely, the construction and shape of nozzle 3 according to this invention are simplified, thereby enabling the provision of a compact and light device.

Further, since air chamber 22 is communicated with atmosphere by way of upper/lower opening surface, the inflow of an external air into air chamber 22 is expedited, and a supplementary air flow 24 is caused as shown in FIG. 2. Supplementary air flow 24 as well as the foregoing hook-shaped air flow wall helps to prevent any scattering of part of metal molten droplets across air chamber 22. The metal molten droplets are going to be scattered in all directions by the arc impact. In particular, its scattering in an upper, lower and rearward directions brings about a loss of metal molten droplets. However, both supplementary air flow 24 and hook-shaped air flow wall prevent such scattering, thereby the metal molten droplets are supplied effectively into the air flow zone of air jet 21.

Further, the metal molten droplets produced by arc discharge are supplied into the air flow zone of air jet 21 mainly by a weaker air flow of zone 30 and supplementarily by supplementary air flow 24. The then weaker air flow and supplementary air flow 24 do not cause any pinch phenomenon at the time of arc discharge because of their low velocity.

This result has been confirmed by the arc fusing device produced as a test device by the present inventor, in which a relative position relationship between the air curtain formed by air jet 21 and the arc intersecting point O has been varied as follows.

Treatment A: The arc discharge was carried out between rear end 30*b* of weaker air flow zone 30 and front end of nozzle 3, shifting arc intersecting point O forward or backward.

Treatment B: The arc discharge was carried out between front end 30*a* and rear end 30*b* of weaker air flow zone 30, shifting arc intersecting point O forward or backward.

Treatment C: The arc discharge was carried out in the air flow zone before front end 30*a* of weaker air flow zone 30, shifting arc intersecting point O forward or backward.

As a result, during Treatment A, part of molten droplets fell scatteringly without entering into air jet 21. Particularly, a large quantity of scattered molten droplets occurred wastefully at the place where the arc intersecting point O is positioned near nozzle 3.

In Treatment C, an explosive fusing of material W occurred in connection with the pinch phenomenon, thereby a coating surface became irregular.

In Treatment B, the arc discharge was carried out smoothly unlike a big loss of molten droplets in Treatment A or such explosive fusing in Treatment C. The coated surface was uniform, and each particle size was so minute that a very suitable atomization was attained.

Based on the foregoing test results, the arc intersecting point O was positioned in weaker air flow zone 30.

Further, it has been confirmed that when making smaller the convergent angle of the air jet during the foregoing test, the molten droplets were supplied suitably into the air jet.

Figure 6:
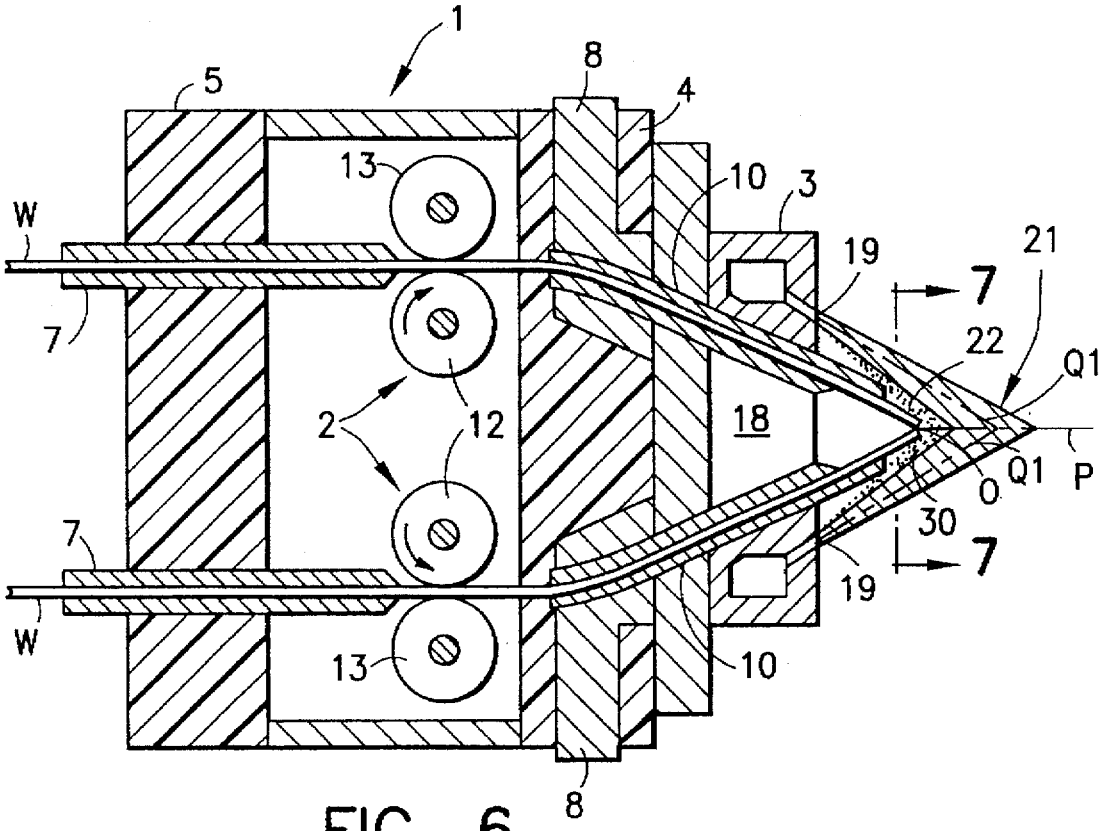
Figure 7:
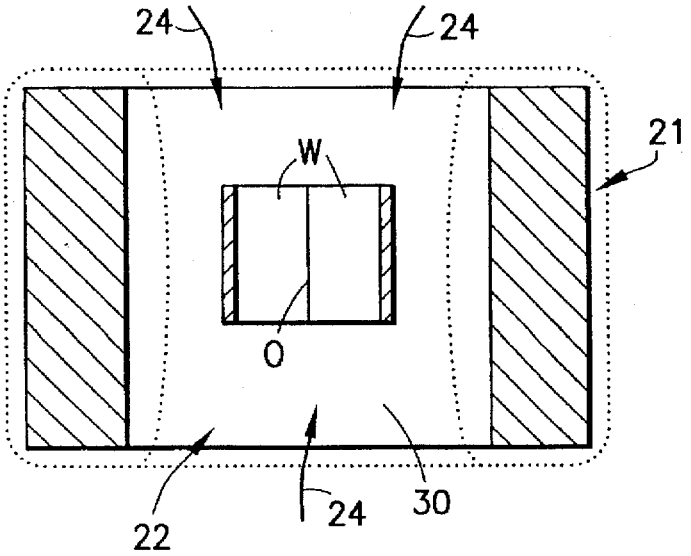

FIGS. 6 and 7 show an embodiment of the arc fusing device using a band-shaped fusible material.

The construction of the arc fusing device in FIG. 6 is generally similar to that of the foregoing arc fusing device.

The main difference is that in FIGS. 6 and 7 a pair of fusible materials W pass through the interior of case 1 in a longitudinal posture and in a left/right parallel manner, and then are fed out by separate feeders 2, 2. Further, whereas in the previous embodiment the jetting center line Q1 in a width direction of nozzle tip 19 and the convergent center line of the fusible material W are positioned on its intersecting plane, in this embodiment the jetting center line Q1 and the convergent center line of fusible material W are positioned side by side. The opening structure of nozzle tip 19 in this embodiment is similar to that in the previous embodiment, but its upper/lower length is sufficiently larger than the width of the fusible material W.

FIGS. 8 to 20 show various modifications of nozzle 3, in which the section of plane air jet 21 is of a clear U-shape or a rectangular shape, and supplementary nozzle tips 31 are disposed in addition to main nozzle 3 or a plurality of nozzle tips 32 for reinforcing air jet 21 are disposed. Since FIGS. 8 to 20 have the same numerals as the previous embodiment, its description will be omitted.

Figure 8:
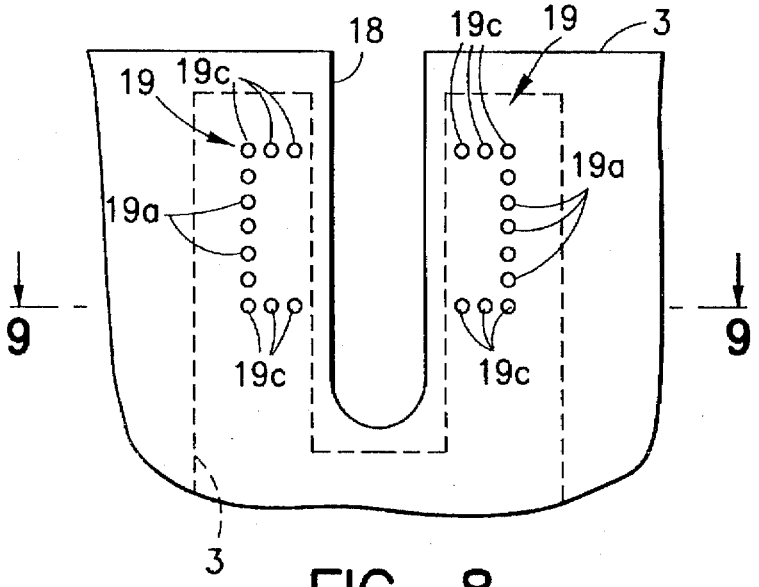

In FIG. 8 each nozzle tip 19 includes a group of small holes 19*a* arranged in a vertical, linear line, a group of small holes 19*c* extended in a horizontal, inward direction, thereby forming a generally U-shaped section. The inclination of the jetting center line Q1 of respective holes 19*a*, 19*c* is set with the same angle.

Figure 9:
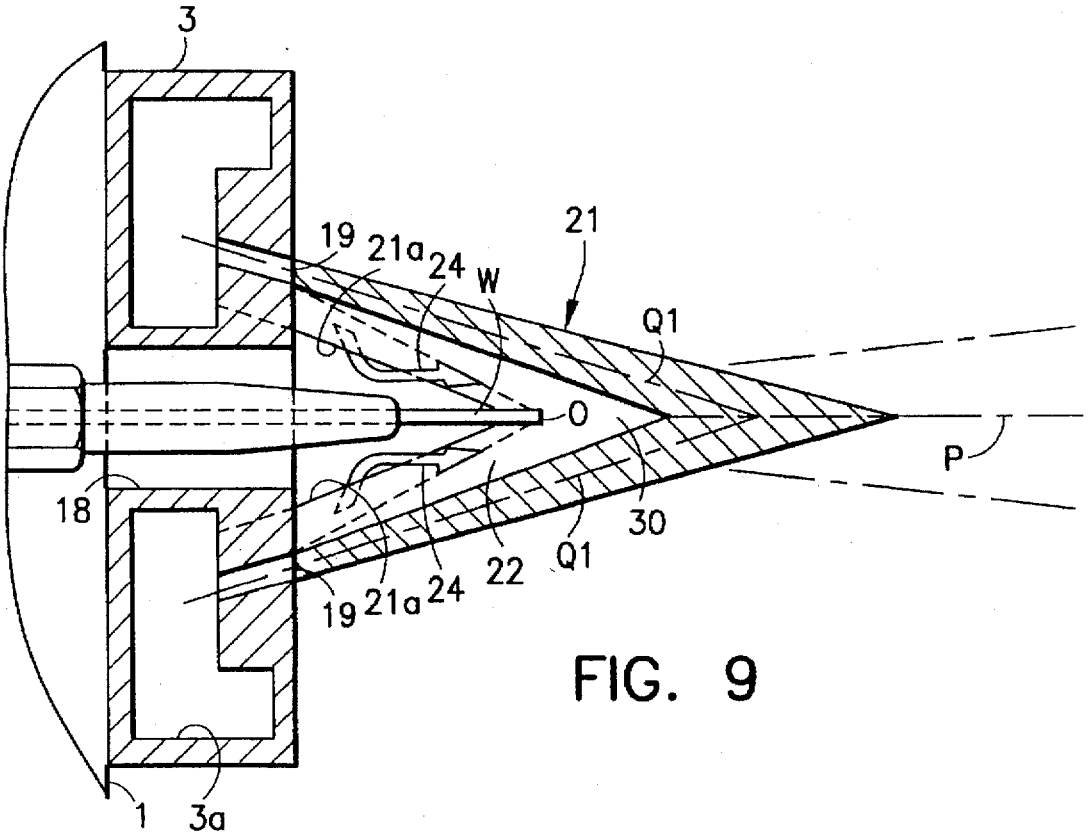

In such a structure as is shown in FIGS. 9 and 10, the upper and lower opening edges of air chamber 22 are covered by a air jet 21*a* jetted from upper/lower nozzles 19*c*, and the section of each air jet 21 forms a clear U-shape, thereby enables preventing completely any scattering of molten droplets in a vertical direction.

In FIG. 11 nozzle tip 19 is provided with a U-shaped slit, thereby the section of air jet 21 forms a U-shape.

In FIGS. 12 and 13, nozzle tip 19 consists of only the group of small holes 19*a* arranged in a vertical, linear line, and upper/lower holes 19*d* are of an outwardly tapered shape, thereby air jet 21 forms U-shaped section.

Figure 14:
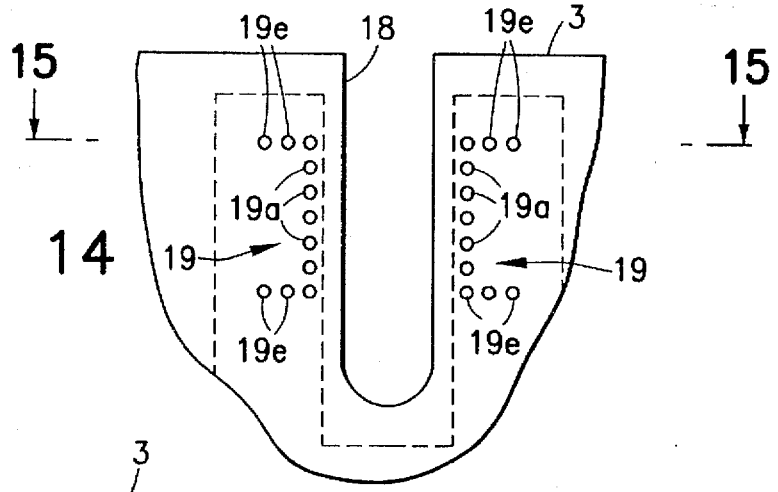
Figure 15:
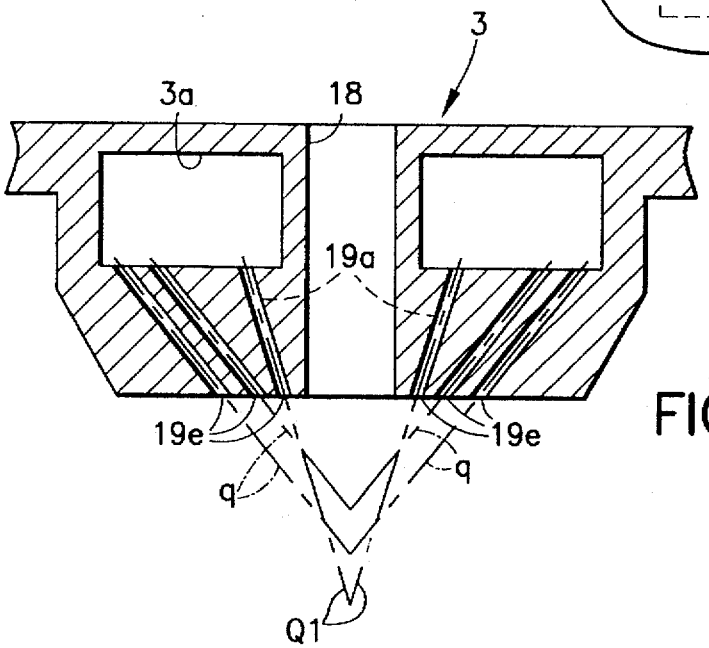

In FIG. 14, nozzle 3 comprises a group of upper/lower small holes 19*e* arranged in a horizontal, outward direction unlike nozzle tips 19 as discussed in FIG. 8. Moreover, as shown in FIG. 15, a jetting center line q of each hole 19*e* is inclined more inwardly than jetting center line Q1 of each hole 19*a*, thereby air jet 21 forms a U-shaped section.

Nozzle 3 in the fusing device in FIGS. 1 to 15 is provided with the hook-shaped air flow wall at both ends of the linear part of air jet 21 to prevent any scattering of molten droplets in a vertical direction, but it is not always to form such a hook-shaped air flow wall.

Figure 16:
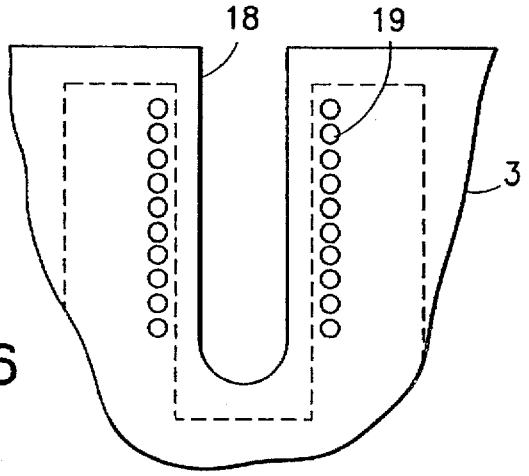
Figure 17:
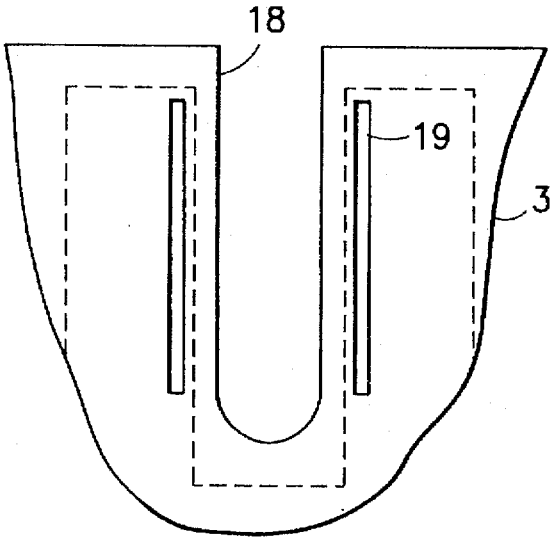
Figure 18:
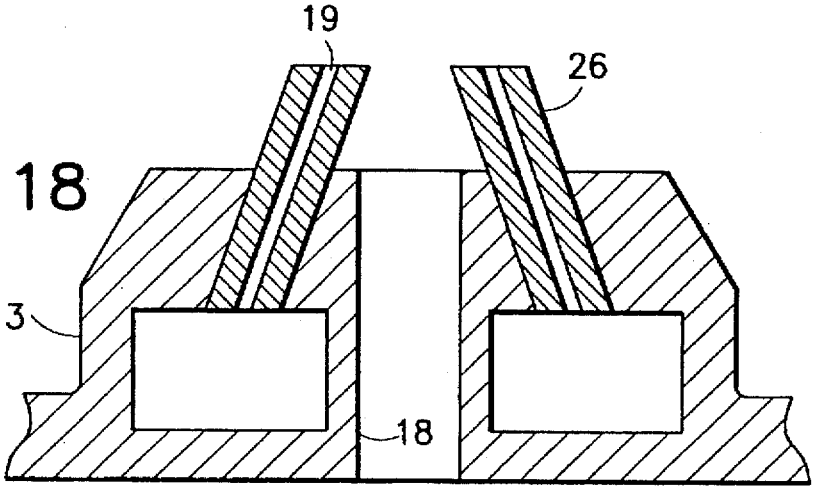

As shown in FIG. 16, nozzle 3 consists of a group of nozzle tips 19 each having the same diameter, which are arranged in a straight line, and in FIG. 17 nozzle 3 consists of a plurality of slit-shaped tips 19 arranged continuously in a straight line. In FIG. 18, nozzle 3 is provided with a ceramic muzzle member 26 disposed therein, and nozzle member 26 has a tip 19 as shown in FIG. 16 or 17.

Plane air jet 21 jetted from nozzle tip 19 in FIGS. 16 to 18 forms a slight bulge at both ends, but does not form a substantially hook-shaped air flow wall. Therefore, nozzle tip 19 requires such a length that both ends of air jet 21 can prevent any upward or downward scattering of metal molten droplets at the time of arc discharge.

Figure 19:
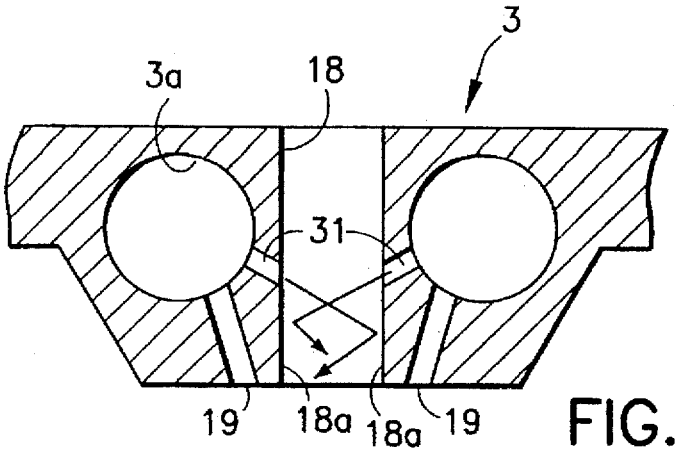

Nozzle 3 in FIG. 19 includes two supplementary nozzle tips 31 at the same height position as the fusing center axis P of respective opposing walls of recess 18, and an air jetting direction from supplementary nozzle tip 31 is directed to two side walls 18*a* of recess 18. With this type of structure, the air jetted from supplementary nozzle 31 collided with side walls 18*a*, and then flows into arc chamber 22, thereby enabling preventing any backward scattering of molten droplets.

Figure 20:
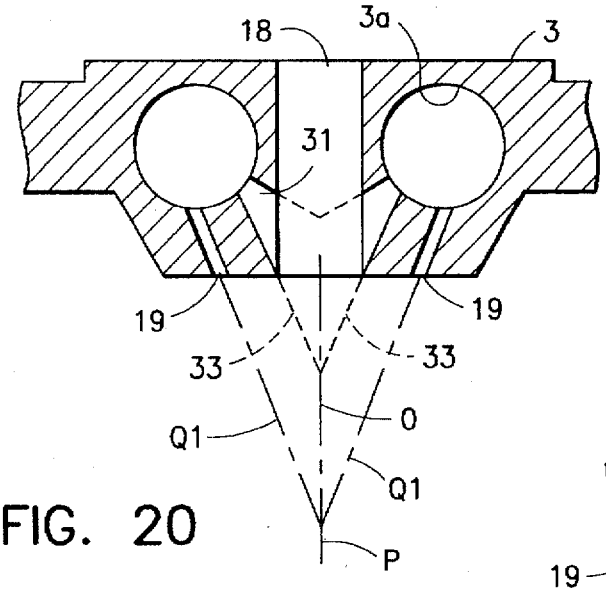

Supplementary nozzle tip 31 may comprise an outwardly extended hole as shown in FIG. 20. In that case, the air flow forms such a hole profile as to be converged at the nozzle side, and any backward scattering of molten droplets can be prevented by rearside supplementary air flow 33.

When disposing supplementary nozzle tips 31 in FIGS. 19 and 20, the foregoing structure of nozzle 19 is acceptable.

Figure 21:
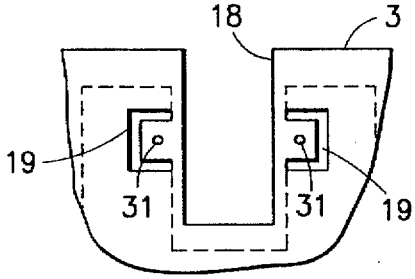

In case nozzle tip 19 forms U-shaped section as shown in FIG. 21, supplementary nozzle tips 31 may be positioned adjacent nozzle tip 19.

Figure 22:
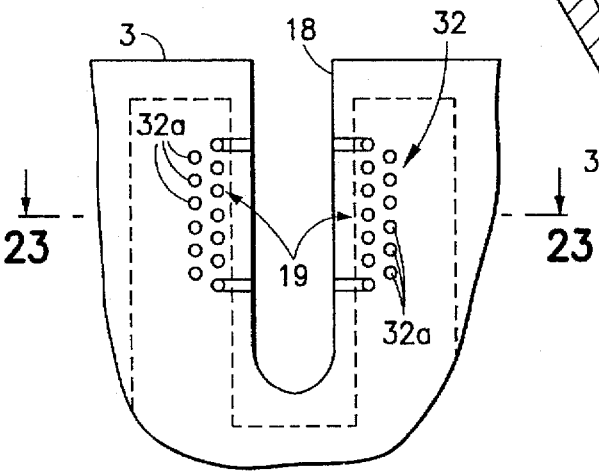
Figure 23:
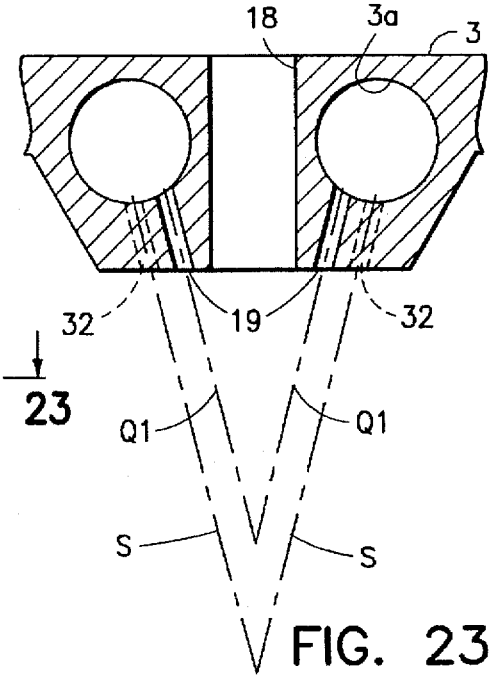

In FIG. 22 nozzle 3 includes a second nozzle tip 32 disposed outwardly parallel with nozzle tip 19, and second nozzle tip 32 consists of a group of small holes 32*a* arranged in a vertical, straight line, in which a jetting center line S is, as shown in FIG. 23, similar to jetting center line Q1 of nozzle tip 19 or inclined in a slightly outward direction. Thus, nozzle 3 can restrict an outward expansion of air jet 21, thereby enabling flattening of the fusing pattern. Further, second nozzle tip 32 can be modified to a U-shaped section or a C-shaped section.

Figure 21A:
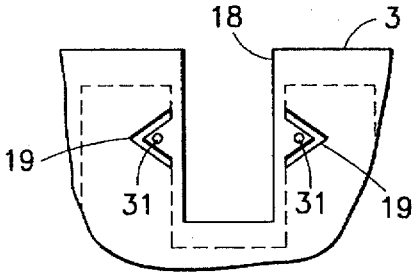

Further, nozzle tip 19 may be an I-shaped section, a C-shaped section, a crescent section, a V-shaped section as shown in FIG. 21*a*, or the like without departing from the spirit and scope of this invention.

According to the foregoing description, a pair of nozzle tips are disposed symmetrically relative to a vertical line over the fusing center axis P, they may be disposed at any place around the fusing center axis P without departing from the spirit and scope of this invention.

According to the foregoing atomizing device, the external surface of the arc area is covered only by air jet curtain 21 jetted from a pair of nozzle tips 19, so that the structure of the nozzle can be more compact lighter than the conventional fusing device.

In particular, according to this invention, air chamber 22 is created by air jet curtain 21 jetted from a pair of nozzle tips, and fusible material W is arc-discharged in weaker air flow zone 30 surrounded by air jet curtain 21. Molten droplets of material W produced by arc discharge are fed into air jet curtain 21 by a weaker air flow of zone 30, and then atomizer. Thus, arc fusing can be carried out very stably with no pinch phenomenon.

Further, when fusing band-shaped material W, air jet curtain 21 can be formed along its external surface, so that arc fusing can be carried out by a small-sized nozzle 3, thereby the fusing device can be more compact.

FIGS. 24 to 37 show the arc fusing device according to a second invention which is a further improvement.

Figure 26:
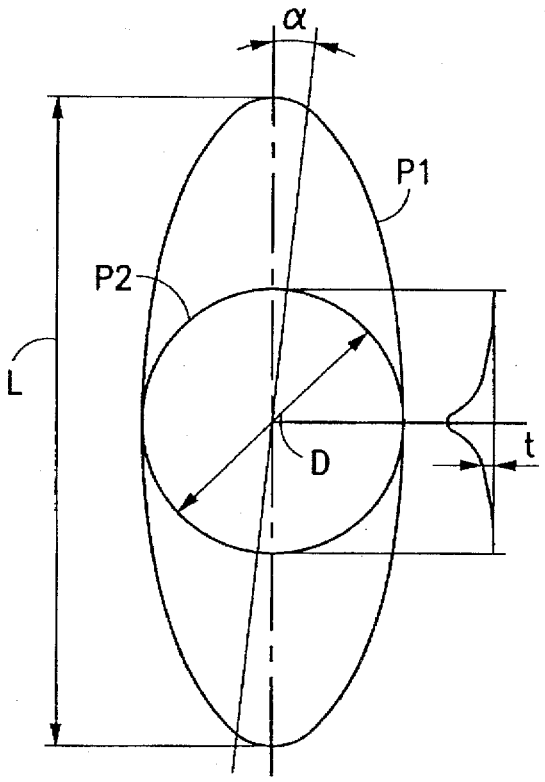
Figure 27:
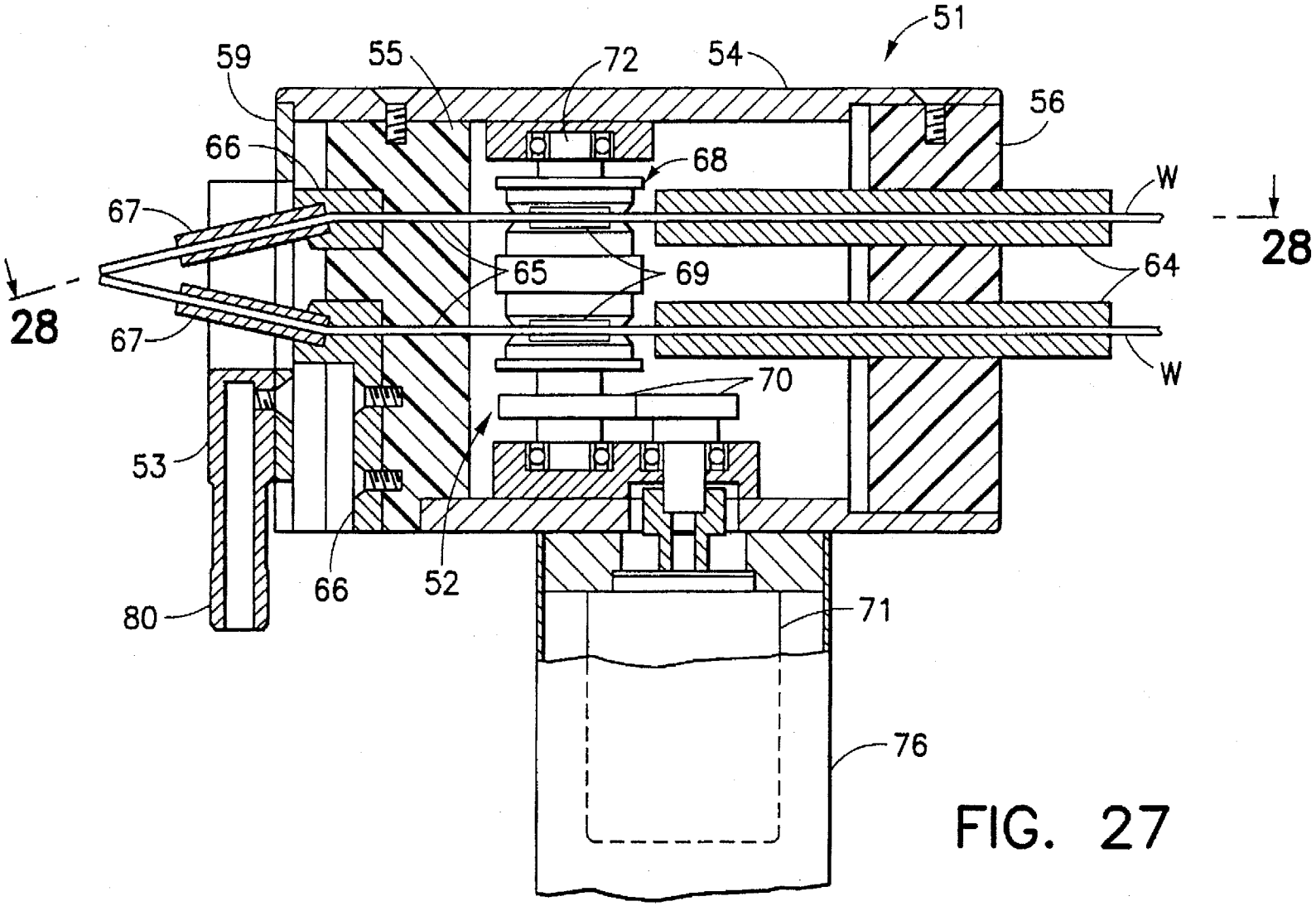

FIGS. 24 to 31 show an embodiment of the arc fusing device according to the second invention. In FIG. 27, the device is to fuse a round wire shaped fusible material W by means of arc discharge, in which material W passes through a channel within a box-shaped case 51 in upper/lower parallel, and means 52 for feeding material W is disposed at the center of case 51. Further, protruded outwardly from a front end of case 51 is nozzle 53 for jetting an air jet for atomizing.

Figure 28:
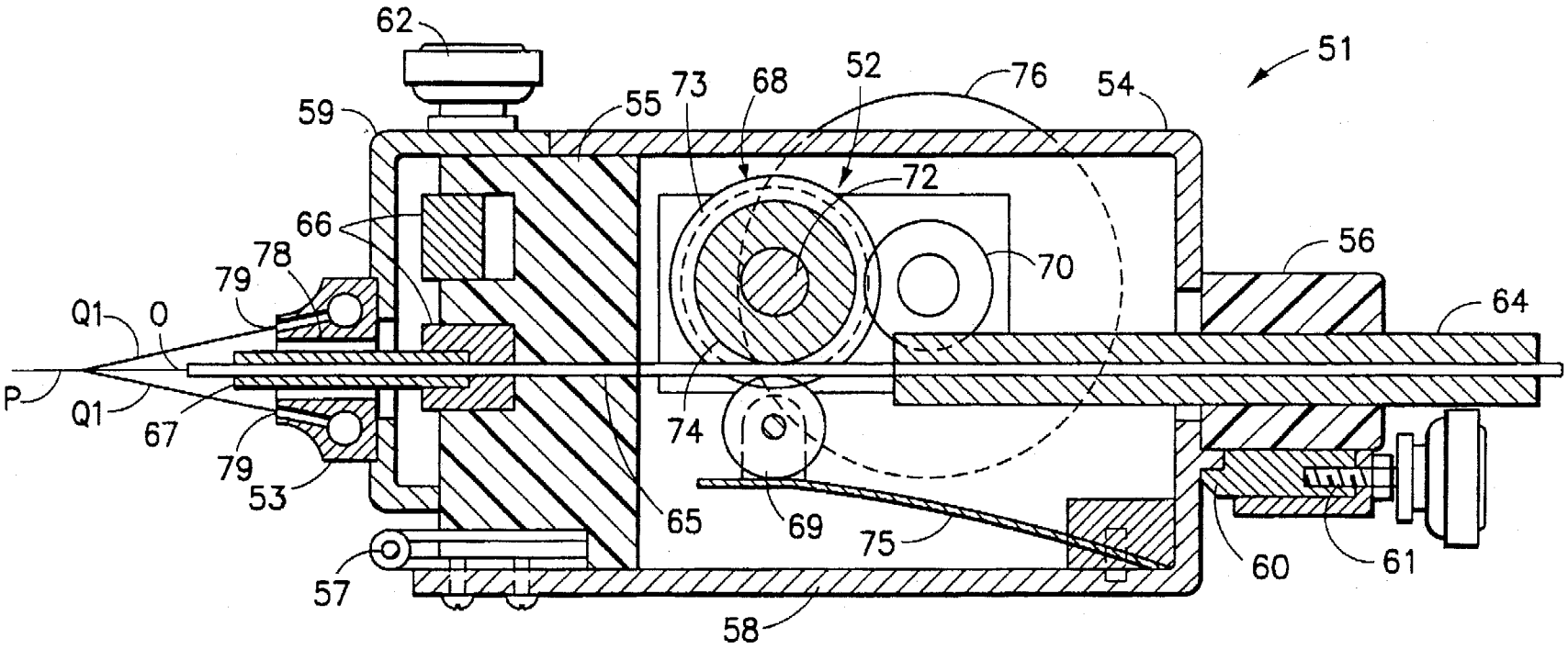

In FIG. 28, case 51 includes a metal case body 54 having an opening at its one side, two insulating blocks fixed with both front and rear ends of case body 54, a swingeable, hinged cover 58 and a bracket 59 for nozzle 53 to cover the front side of insulating block 55. Cover 58 is maintained closed by a latch 60. When sliding latch 60 against a spring 61, cover 58 can be opened simply. Further, by loosening a screw 62, bracket 59 can be removed from insulating block 55, thereby enabling a convenient replacement of nozzle 53.

To feed and guide fusible material W, a pair of upper/lower guide tubes 64 are fixed with rearside insulating block 56, and a pair of feeding channels 65 are formed in frontside insulating block 55 to correspond to a pair of guide tubes 64. Each channel 65 has a terminal 66, in front of which is fixed with an arc guide tube 67. Each of two terminals 66 is connected to respective electric wires, to one of which a positive current is supplied, while to the other of which a negative current is supplied.

As shown in FIG. 27, each front end of upper flower arc guide tubes 67 are connected to each other in an inclined posture, and upper/lower fusible material W is guided and directed toward arc intersecting point O before nozzle 53. At the time of this guiding, fusible material W is pressed to the inner wall of arc guide tube 67, thereby the arc current can be applied stably.

Means 52 for feeding material W is disposed between frontside insulating block 55 and guide tube 64, and effective to feed upper flower materials W in a forward direction of case 54. In FIGS. 27 and 28, feeding means 52 includes a driving roller 68 rotatably supported on the upper flower walls of case 54, a pair of support rollers 69 for pressing fusible material W to roller 68 and a motor 71 for driving roller 68 by way of a pair if gears 70.

Driving roller 68 is, on its shaft 72, fixed with an insulating roller 73. A V-shaped metal ring 74 is fixed with each of two upper/lower positions of insulating roller 73. Material W is supported by metal rings 74 and support rollers 69, and fed forcibly to a given place. To prevent any slipping, a periphery of metal ring 74 is notched.

Support rollers 69 are also made of an insulating material, and disposed on an upper and lower position to correspond to insulating rollers 73. Each of support rollers 69 is rotatably supported on one end of a spring arm 75, and pressed to driving roller 68 due to a resilient force of spring arm 75. An end of spring arm 75 is fixed with the inner wall of cover 58.

As shown in FIG. 27, motor 71 is incorporated in a grip 76 fixed with the underside of case 51. By turning on a switch (not illustrated), a driving force is transferred to roller 68 by way of gears 70, thereby motor 71 is driven.

Nozzle 53 is formed in a lengthy hollow box shape. Formed at a center of the upper half of it is a recess 78 for deviating arc guide tube 67, and formed along respective leftside/rightside walls divided by recess 78 is a nozzle tip 79. Numeral 80 is a joint for connecting an air hose.

Figure 24:
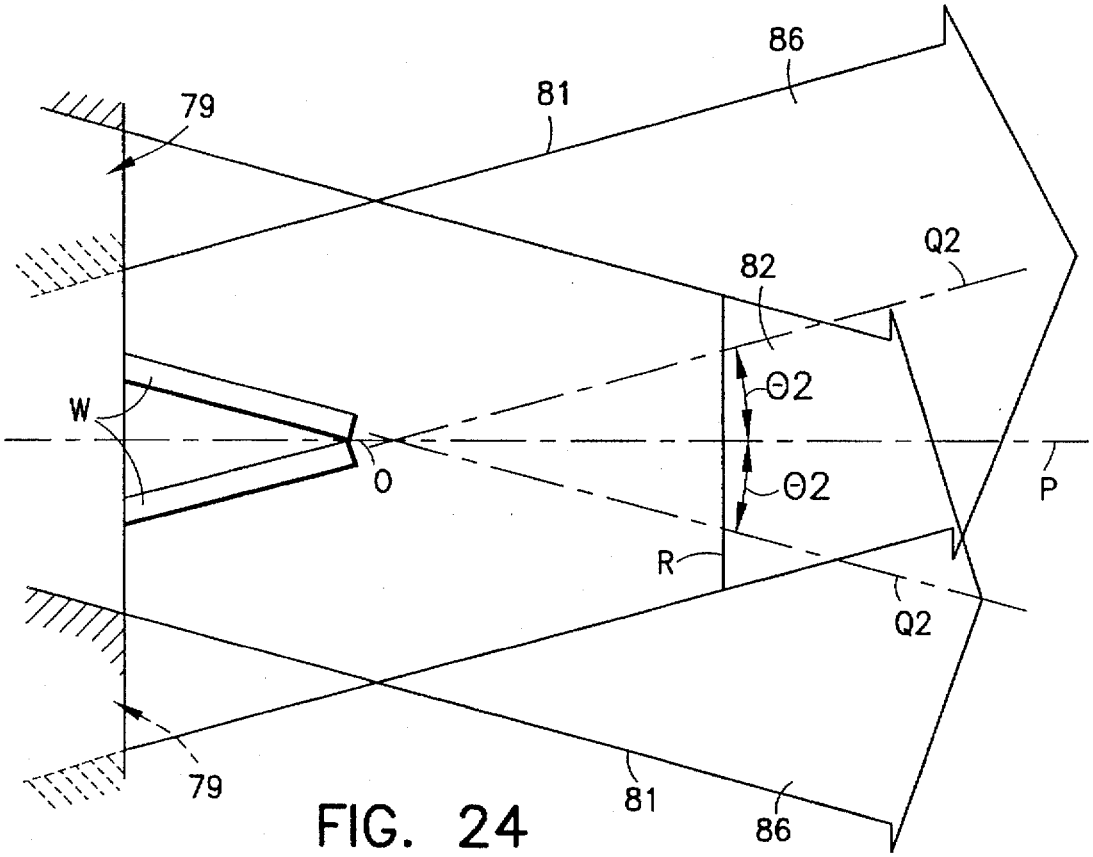
Figure 25:
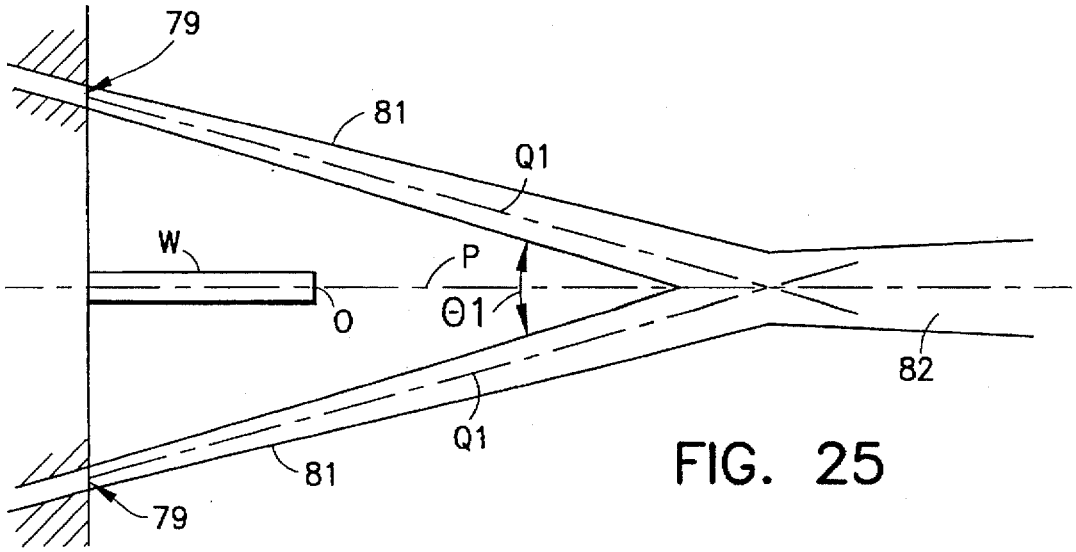
Figure 30:
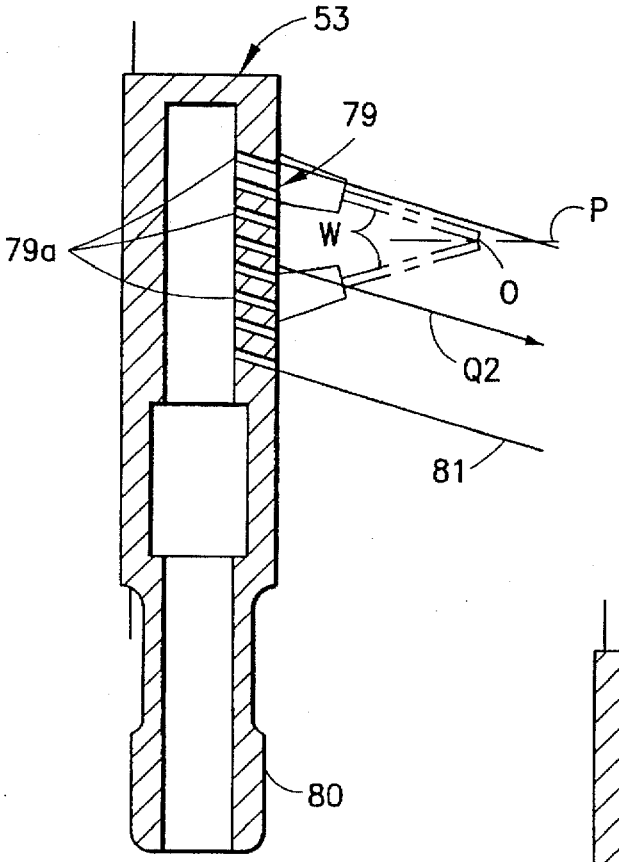
Figure 31:
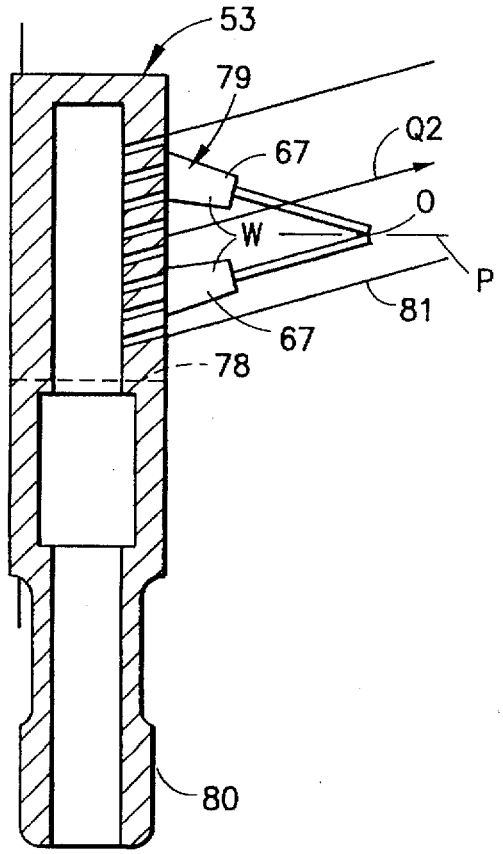

Each nozzle tip 79 comprises a group of small holes **79*a* in a vertical line, and a plurality of air jets jetted from those holes are united together, and then form a plane air jet 81. A jetting direction of air jet 81 is oriented such that its thickness center line Q1 is inclined toward a fusing center line P positioned in a forward direction of the arc intersecting point O of fusible material W. Further, as shown in FIGS. 30 and 31, respective center lines Q2, Q2 in a width direction of air jets 81 are inclined to oppose each other relative to the fusing center line P, and both air jets 81 are intersected with each other in a convergent form (as shown in FIG. 24). Preferably, an angle 0 1 of the thickness center line Q1 is set in the range of 12 degrees to 24 degrees. Further, an inclination angle 02** of center line Q2 must have a convergent portion R and be intersected, but is preferably set in the range of 5 degrees to 40 degrees.

Figure 29:
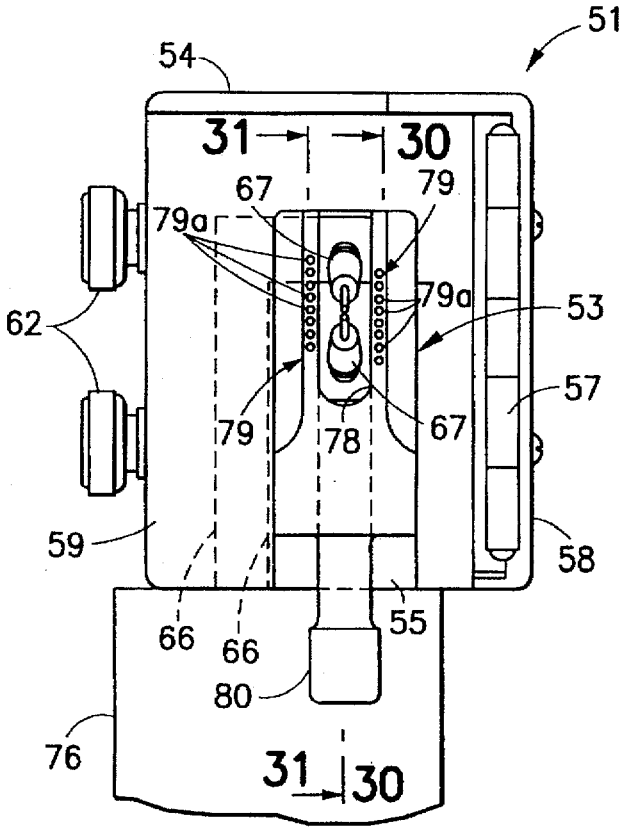

To reduce the number of small holes **79*a* as well as the air consumption, the height position of nozzle tips 79 is a little changed in connection with the inclined direction of center line Q2. As shown in FIG. 29, leftside nozzle tip 79 is disposed a little upwardly relative to fusing center line P, while rightside nozzle tip 79** is disposed a little downwardly.

V-shaped air curtain is formed by air jets 81, 81 jetted from both nozzle tips 79, 79, inside which is formed an air chamber. Arc intersecting point O for fusing material W is positioned on fusing center line P in a weaker air flow zone flowing in a convergent direction of air jets 81. Numeral 82 is an air flow converged in a forward direction of convergent portion R of air jets 81.

The arc fusion was carried out by making use of nozzle 53. Molten droplets of material W were atomized within intersecting air flow 86 without uniting with convergent air flow 82. Thus, an elliptical fusing pattern P1 was obtained as shown in FIG. 26. The length of a short axis of pattern P1 was nearly similar to a diameter D of fusing pattern P2 in the device according to the first invention, while the length of a long axis thereof was three times as large as the foregoing diameter. This means that the same quantity of molten droplets were scattered in a wider scope, and it has been confirmed that the coated thickness in fusing pattern P1 was formed uniformly. The long axis of fusing pattern P1 $\alpha$ is inclined with an angle relative to a vertical center line of the fusing device. The reason for this is that the center line Q2 in a width direction of air jet 81 is inclined, and twisted in one direction after intersection.

Figure 32:
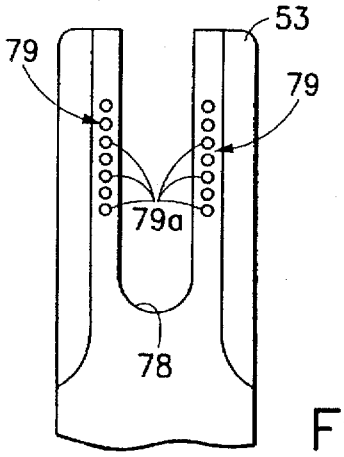
Figure 33:
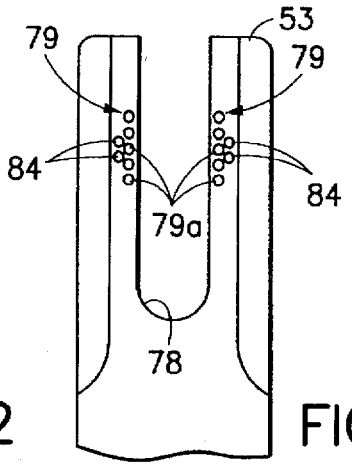

FIGS. 32 and 33 show modifications of the position of small holes 79. In FIG. 32 the height of leftside and rightside nozzle tips 79 is the same, and they are arranged in a symmetrical form. In FIG. 33 a plurality of supplementary nozzle tips 84 are disposed outside nozzle tips 79.

Figure 34:
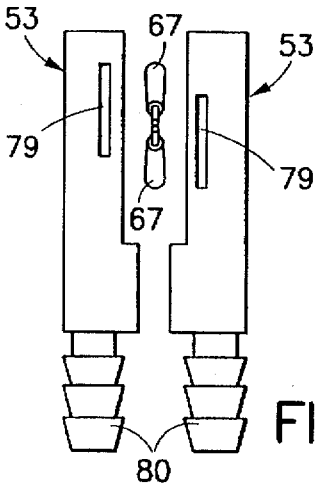
Figure 35:
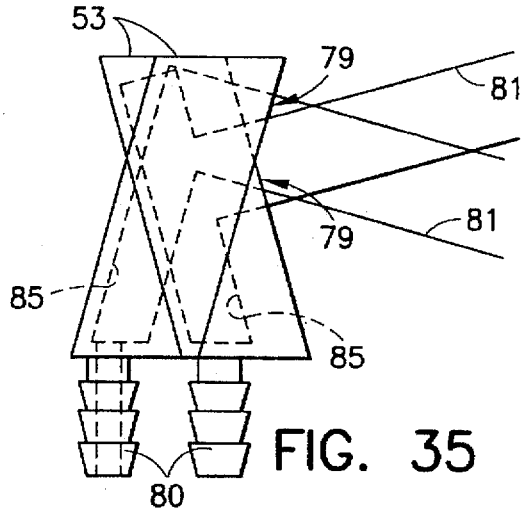
Figure 36:
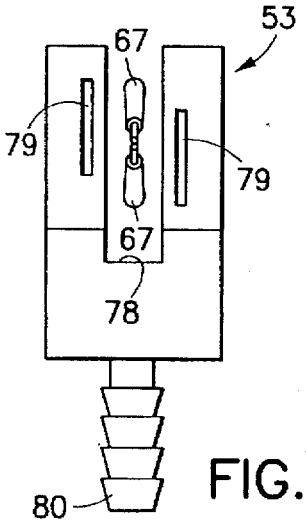
Figure 37:
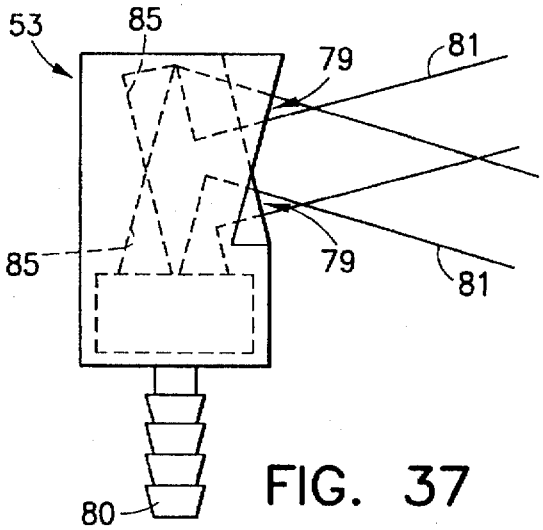

As shown in FIGS. 34 to 36, nozzle tips 79 may be formed in a slit shape. Then, it is required to incline an air chamber 85 in nozzle 53 to some extent, thereby air jets 81 formed by both nozzles 79, 79 can have the same orientation as the air jet in the foregoing embodiment. In case the slit-shaped nozzle tips are formed, a large quantity of air can be supplied, so that a large-sized fusing device is available. In FIGS. 34 and 35, a pair of nozzles 53 are combined with each other, and in FIGS. 36 and 37 one nozzle 53 has a pair of nozzle tips 79.

The inclination angle of center line Q2 in a width direction of air jet 81 may be modified in a left/right direction.

Fusible material W may be of a band shape. In that case, air jet 81 is jetted in a longitudinal direction of material W.

In such fusing device, plane air jets 81 are jetted from a pair of nozzle tips 79, and material W is fused within the air chamber surrounded by both air jets 81. Since nozzle tips 79 are inclined so that the center lines Q2 in a width direction of respective air jets 81 are inclined to oppose each other, molten droplets are scattered within the air jet at the time of atomizing. As a result, such a elliptical fusing pattern P1 can be obtained, thereby its pattern area is enlarged several times as large as the conventional one.

Accordingly, the foregoing fusing device enables formation of an atomized coating very efficiently and speedily, so that the productivity of atomization is enhanced greatly. Even a larger object may be atomized and coated speedily. Further, the thickness of the coated surface is formed so uniform that the product can enjoy a high quality and fidelity. Since any thick portion on the coating is not formed, any stripping of the coating due to any localized heat can be prevented.

FIGS. 38 to 48 show an embodiment of the third invention, in which a paint, a blast material, an adhesive, a power or other atomizing material is applied to the atomizing device. The fusing device according to the first or second invention may be, in a broader sense, defined as the atomizing device, since metal molten droplets are atomized on an object.

The atomizing device according to the third invention comprises means 102 for supplying an atomizing material 101 such as a paint, a blast material, an adhesive or the like and an air nozzle 103 for atomizing material 101.

Means 102 for supplying material 101 includes a cup-shaped container 104 for storing material 101 and a tube 105 for supplying it, thereby material 101 within container 104 is discharged from tube 105 under the compression of the air supplied through an air tube 106. Supply tube 105 includes a valve for supplying material 101 and a flow regulating valve, both of which are not illustrated. Numeral 115 is a surface of an object to be atomized.

Figure 39:
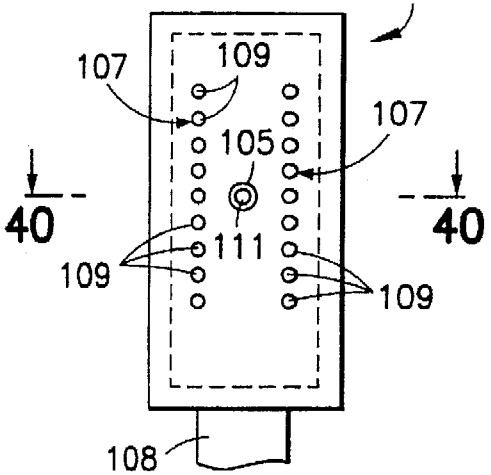

In FIG. 39 air nozzle 103 is formed in a rectangular box shape, on the front wall of which are formed a pair of leftside/rightside nozzle tips 107. Supply tube 105 is positioned at a center of nozzle 103. Pair of nozzle tips 107 are arranged symmetrically at the leftside and rightside. Numeral 108 is a joint for connecting an air hose.

Figure 40:
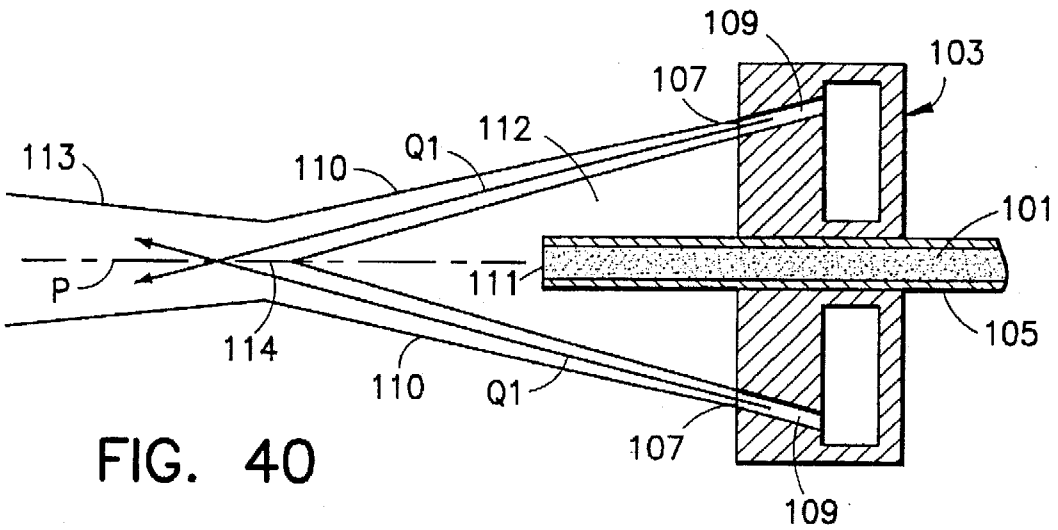

Each nozzle tip 109 consists of a group of small holes 109 arranged in a straight line, which are effective to jet a plane air jet 110. As shown in FIG. 40, a jetting direction of nozzles tip 107 is oriented such that center line Q1 in a width direction of air jet 110 can be converged toward the jetting center axis P in a forward direction of an outlet 111 of supply tube 105. Thus, a V-shaped air curtain is formed by both air jets 110, inside which is defined a wedge-shaped chamber 112. Both air jets 110 are united into one before or after center line Q1, thereby a convergent air flow 113 is established. Convergent air flow 113 is formed in a straight line, while increasing its sectional area gradually along center line P. Thus, it exhibits a strong orientation.

Outlet 11 of supply tube 105 is positioned on the jetting center axis P in a weaker zone of air chamber 112.

According to the foregoing atomizing device, atomizing material 101 is supplied in a non-atomizing manner. More specifically, atomizing material 101 is discharged into air chamber 112 from outlet 111 of supply tube 105. Formed within air chamber 112 is a weaker air flowing toward a convergent portion 114. Therefore, atomizing material 101 is moved to convergent portion 114, increasing air velocity gradually with weaker air flow, during which moving time it is fractionated, and then absorbed into the interior of air jet 110.

There is a big gap between the moving velocity of material 101 and the velocity of air jet 110. For this reason, material 101 is absorbed in air jet 110, and then fractionated. Then, fractionated material 101 passes through convergent portion 114, at which both air jets 110 collide with each other. At convergent portion 114, fractionated material 101 is strongly pressurized and then atomized by air jets 110 having different air flow directions. Thus, material 101 finely atomized during passing through a turbulent flow area of convergent portion 114 is dispersed uniformly in the air flow, and carried to the object surface 115 by convergent air flow 113. Convergent air flow 113 having a strong orientation collides with the surface 115, while accompanying ambient air.

Figure 38:
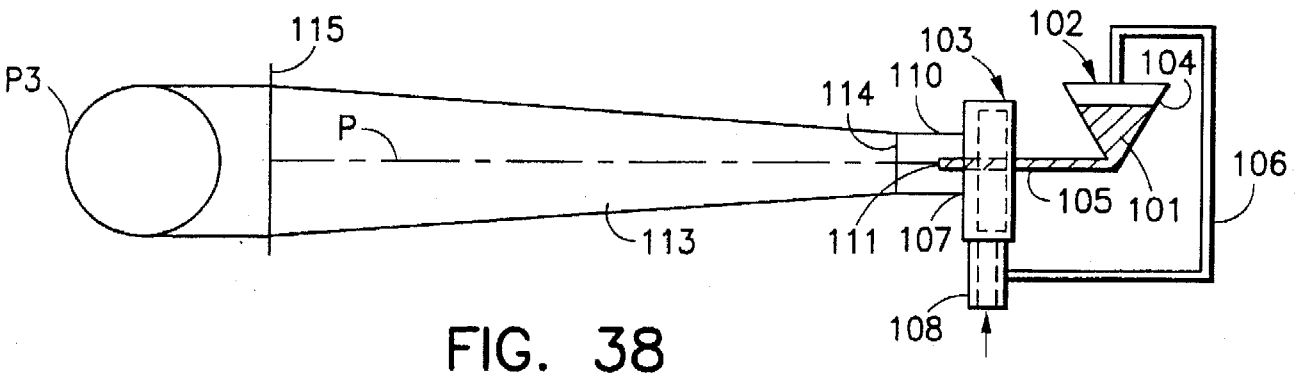

Accordingly, any atomized material 101 cannot be out of convergent air flow 113, so that occurrence of any ineffective mists can be prevented. As shown in FIG. 38, a spraying pattern P3 forms an approximate circle.

Figure 41:
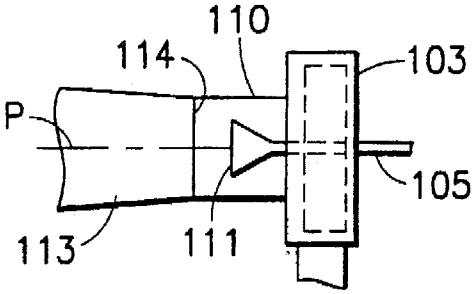

Outlet 111 of supply tube 105 may be modified as shown in FIG. 41. It is formed in a slit shape so as to disperse atomizing material 101 in upper/lower directions of air jet 110. In this case, spraying pattern P3 has the same profile as in FIG. 38.

Outlet 111 of supply tube 105 may be open on the front wall of air nozzle 103.

Further, atomizing material 101 may be supplied by making use of gravity, so that air pressure supply is not always necessary. Further, it is also not always necessary to supply it by use of supply tube 105.

FIGS. 42 to 45 show a further embodiment of the third invention, in which an atomizing pattern P4 forms an elongated circle or an elliptical shape.

Figure 42:
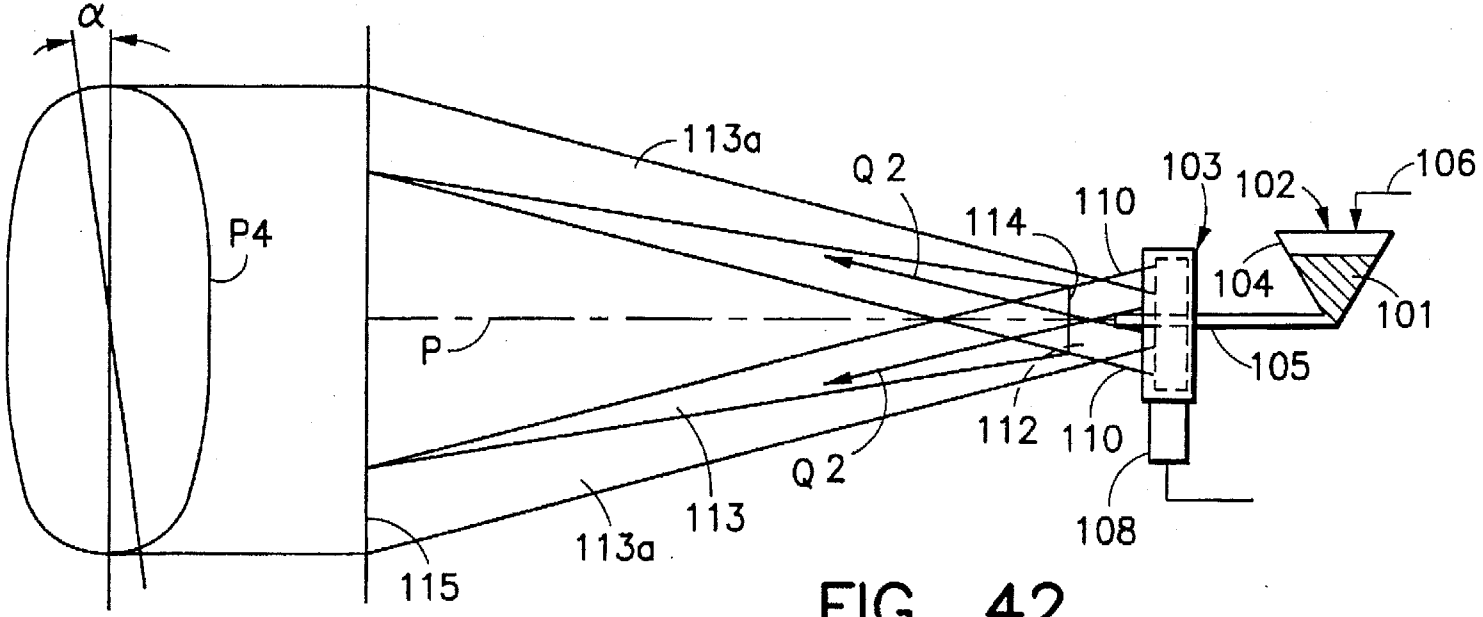

Like the foregoing embodiment, the jetting direction of respective nozzle tips 107 is oriented such that center line Q1 in a width direction of both air jets 110 is converged toward the jetting center line P. Further, as shown in FIG. 42, center lines Q2 in a width direction of both air jets 110 are inclined to oppose to each other relative to center axis P. Thus, most of both air jets 110 in a width direction are converged in V shape, and a non-convergent air flow area 113*a* is formed upon and under convergent air flow 113.

Figure 43:
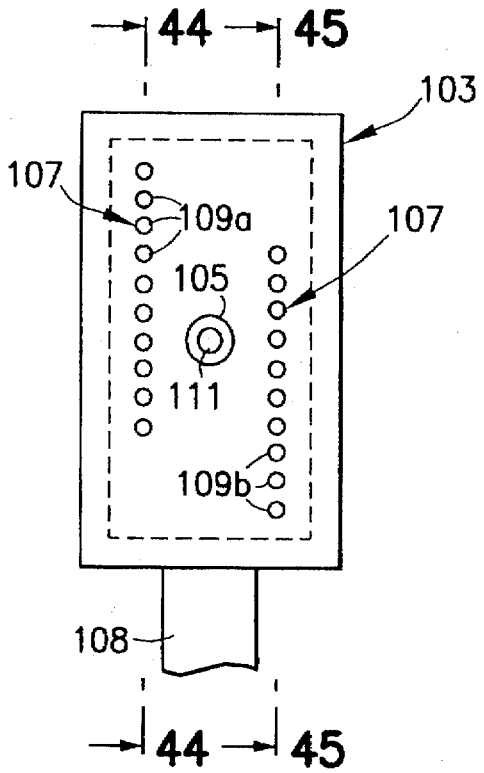
Figure 44:
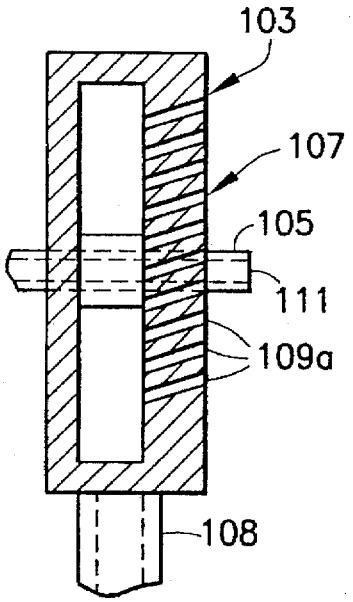
Figure 45:
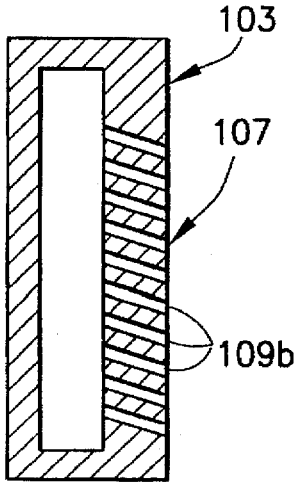

Center line Q2 is inclined to reduce the air consumption. Namely, as shown in FIGS. 43 to 45, two groups 109*a*, 109*b* of small holes are shifted in height. More particularly, the leftside group 109*a* is positioned a little upwardly toward center axis P, while the rightside group 109*b* is positioned a little downwardly.

By operating the foregoing atomizing device, a sprayed pattern P4 of a lengthy circle is obtained. The length of a short axis of pattern P4 is similar to that of the sprayed pattern P3 in the third invention, while the length of a long axis is about three times as large as the diameter thereof. This means that the same quantity of atomizing material 101 is scattered in a wider scope.

The long axis of sprayed pattern P4 is inclined with the angle a. This is due to the fact that each of center lines Q2 of air jets 110 has a certain inclination, and the intersected air jets are twisted in one direction.

The structure of air nozzle 103 may be changed into that of nozzle 53 as described in FIGS. 34 to 37, that is, nozzle tips may be formed in a slit shape. In case nozzle tips are of slit shape, the quantity of jetting air is increased, thereby it is possible to increase the spraying quantity of atomizing material 101 per hour.

Figure 46:
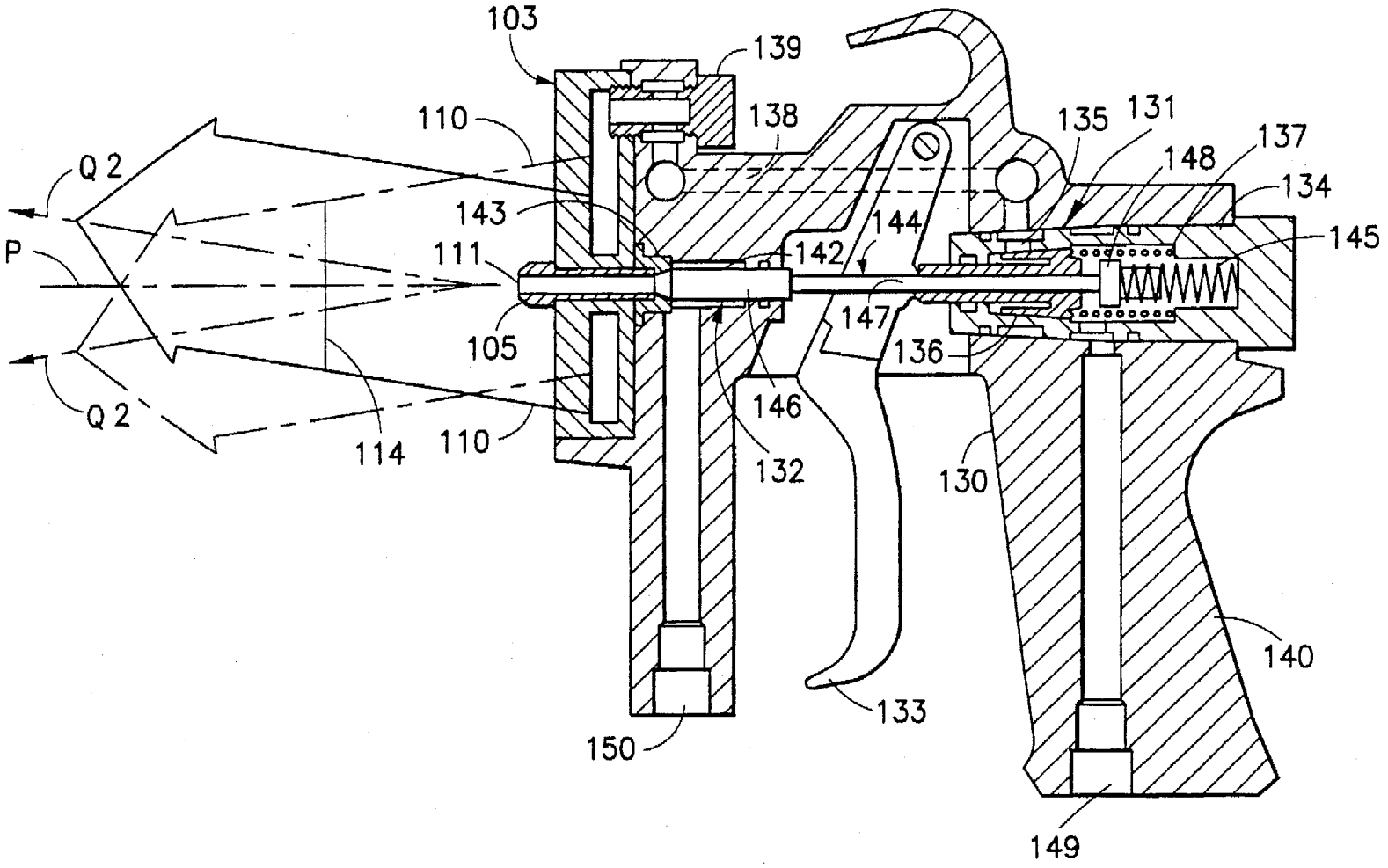
Figure 47:
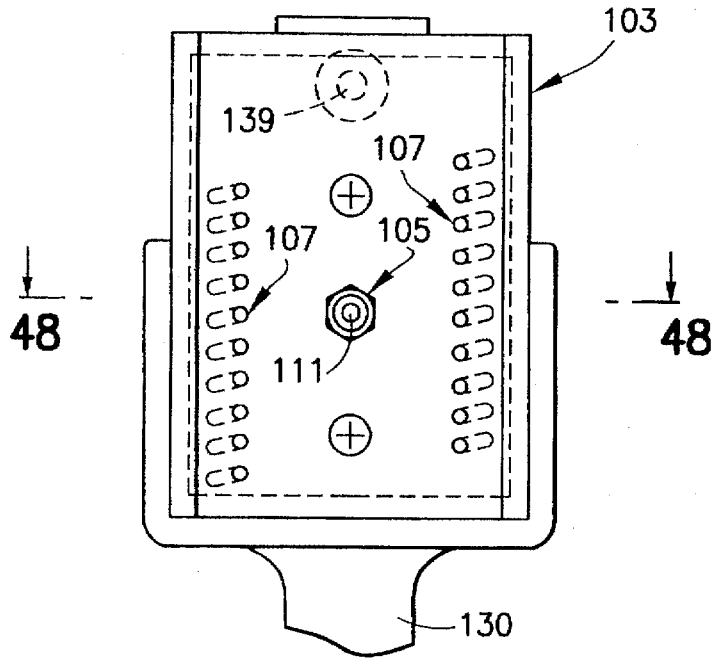
Figure 48:
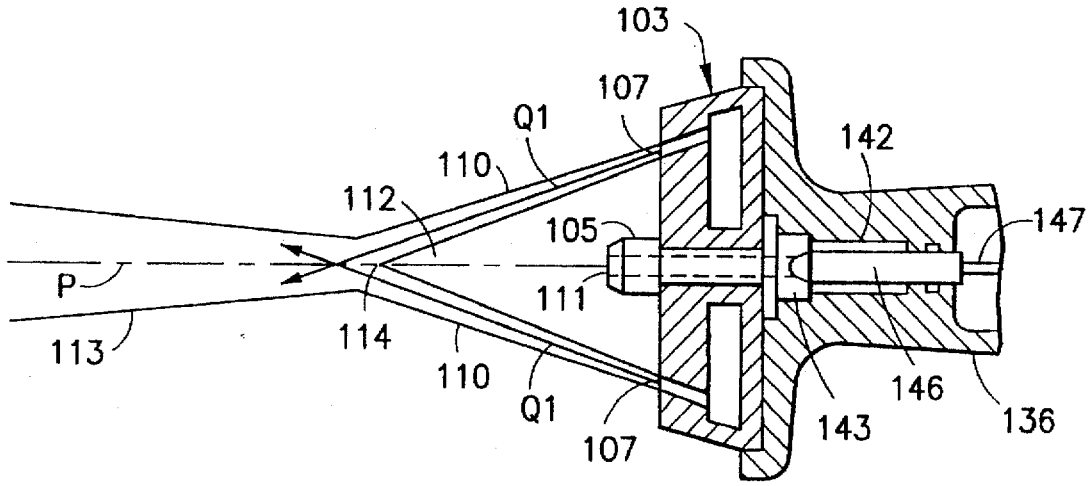

FIGS. 46 to 48 show an embodiment of a spray gun for painting which is applied for the third invention.

In FIG. 48, a spray gun includes a body 130, an air valve 131 and a paint valve 132 incorporated therein, a trigger for operating two valves 131, 132, an air nozzle 103 mounted on a front end of body 130 and a supply tube 105.

Air valve 131 includes a valve case 134, a plug means 136 for operating a valve port 135 disposed in valve case 134 and a valve spring 137 for closing plug member 136. Air valve 131 is disposed above a grip 140. When pulling trigger 133, plug means 136 is retracted against valve spring 137, thereby a gap is formed between plug means 136 and valve case 134. A compressed air is supplied into air nozzle 103 from this gap by way of valve port 135 and an air path 138. Air nozzle 103 and air path 138 are communicated with each other through joint 139. Numeral 149 is a channel for supplying compressed air.

Paint valve 132 which is positioned in front of trigger 133 includes a valve seat 143 disposed before a valve chamber 142, a valve rod 144 for switching valve seat 143 and a valve spring 145 for pressing the whole of valve rod 144 toward valve seat 143. Valve rod comprises a valve body 146, a rod 147 for penetrating into plug member 136 and an interconnecting piece 148 for receiving an end of valve spring 145. More particularly, after plug member 136 has been operated and then compressed air has been jetted from air nozzle 103, valve body 146 is to be departed from valve seat 143. To attain a delay of this motion, there is a small gap between plug member 135 and interconnecting piece 148. Numeral 150 is a channel for supplying a paint. The paint which is stored in a separate tank may be supplied to channel 150 by the function of gravity or a compressed air within the tank.

A pair of air jets 110 are jetted from two groups 107 of small holes. Center lines Q1 in a thickness direction and center lines Q2 in a width direction are inclined in the same way as air nozzle 103 in the fifth embodiment. The difference is that the compressed air is introduced from a rear/upper side of air nozzle 103.

Supply pipe 105 is fixed with valve seat 143, penetrating into air nozzle 103. Accordingly, if there are prepared a plurality of supply tubes 105 each having a different diameter of outlet 111, it is easy to replace with a suitable supply tube 105 according to respective viscosity of the paint.

The opening of each nozzle tip 107 may be open in a linear line shape or in a moderately curved shape. Further, a pair of nozzle tips 107 may be disposed in upper/lower parallel. Still further, air jets may be jetted from three groups of nozzle tips 107.

According to the foregoing atomizing device, plane air jet 110 is jetted from air nozzle 103, and then converged toward atomizing center line P, inside which is defined air chamber 112. Atomizing material 101 is supplied within air chamber 112 in a non-atomizing form. Further, convergent air flow 113 is formed by converged air jet 110, thereby allowing atomized material 101 to be sprayed on surface 105.

Accordingly, material 101 can be atomized without using nozzles, so that the clogging problem in the nozzle which is unavoidable in the conventional device can be solved. Since it is possible to wipe away various problems in connection with the clogging problem, the operation and maintenance of the present device can be simplified. Further, it is also possible to atomize effectively a high viscosity paint or adhesive or even a powder.

Further, even though a shot-blast material is used as atomizing material 101, it is supplied in a non-atomizing shape, so that it is possible to prevent wear of supply means 111.

Material 101 is finally atomized in convergent portion 114 of air jets 110, and then atomized material 101 is carried to surface 115 to be sprayed, by regularly convergent air flow 113. Thus, occurrence of ineffective mists can be prevented. A further advantage is to prevent any pollution of the working environment for example by atomizing material 101 or a solvent and realize an effective consumption of atomizing material 101. Further, in comparison to a conventional atomizing device equipped with a high-accurately machined nozzle, air cap or the like, the present atomizing device can be produced at a low cost.

Further, the present means for supplying atomizing material is free from the problem of nozzle clogging or wear, and the principle of atomization is very simple. Atomization can be carried out accurately and stably. For example, even though some atomizing material sticks to the supply means 111, accurate and stable atomization can be accomplished, thereby enhancing operational reliability.

As will be understood by the foregoing description, the atomizing device according to this invention is not only useful for a metal fusing device to be represented by an arc fusing device or an atomizer for painting, but also applicable for atomizing a fluid material such as an adhesive, a powder or a blast material other than a paint, which can be atomized by a compressed air.

What is claimed is:

1. An arc fusing method comprising:

forming a pair of plane air jets, each said plane air jet having a thickness center line and a width center line;

jetting said pair of plane air jets from a pair of nozzle tips toward a convergent portion on a fusing center axis, said thickness center line converging on said fusing center axis in front of an arc intersecting point, said fusing center axis being interposed between said pair of nozzle tips;

jetting air in a first of said pair of plain air jets along said width center line in an incline with respect to said fusing center axis while jetting air in a second of said pair of plain air jets along said width center line in an opposite incline with respect to said fusing center axis;

forming an air chamber bounded by converging of said thickness center lines of said pair of plane air jets on said fusing center axis; and generating an arc discharge continuously between a pair of fusible materials at said arc discharge point in a low velocity air flow zone toward a convergent portion within said air chamber.

2. An arc fusing device comprising:

first and second nozzle tips for forming first and second plane air jets respectively;

each said first and second plane air jet having a thickness center line and a width center line;

said first and second nozzle tips being directed inwardly to converge said thickness center lines toward a fusing center axis thus forming a convergent portion;

said first nozzle tip being positioned in a first offset position and said first nozzle tip being directed whereby said width center line of said first plane air jet is inclined with respect to said fusing center axis;

said second nozzle tip being positioned in a second offset position and said second nozzle tip being directed whereby said width center line of said second plane air jet is inclined with respect to said fusing center axis and oppositely inclined with respect to said width center line of said first plane air jet; and an arc intersecting point of a pair of fusible materials being positioned in a low velocity air flow zone toward a convergent portion within an air chamber defined by said pair of plane air jets and in a rear position in a longitudinal direction of said convergent portion.

3. An arc fusing device as claimed in claim 2, in which each of said first and second nozzle tips is a straight line.

4. An arc fusing device as claimed in claim 3, in which each of said first and second nozzle tips includes a group of small holes formed in a straight line.

5. An arc fusing device as claimed in claim 3, in which each of said first and second nozzle tips includes a straight line slit.

6. An arc fusing device as claimed in claim 2, in which each of said first and second nozzle tips includes a V-shape at its front end.

7. An arc fusing device as claimed in claim 3, in which a supplementary nozzle tip for forming an air flow toward an arc intersecting point is disposed adjacent each of said first and second nozzle tips in said air chamber.

8. An arc fusing device as claimed in claim 3, in which another nozzle tip directed to form a substantially parallel air flow along an external surface of each of said first and second air jets disposed adjacent each of said first and second nozzle tips.

* * * * *